US007328467B2

(12) United States Patent
Aarestad

(10) Patent No.: US 7,328,467 B2
(45) Date of Patent: Feb. 12, 2008

(54) PATIENT LIFT AND TRANSFER DEVICE AND METHOD

(76) Inventor: Jerome K. Aarestad, 1996 Trousdale Pl., Escondido, CA (US) 92029

( * ) Notice: Subject to any disclaimer, the term of this patent is extended or adjusted under 35 U.S.C. 154(b) by 56 days.

(21) Appl. No.: 10/932,267

(22) Filed: Sep. 2, 2004

(65) Prior Publication Data

US 2005/0217024 A1 Oct. 6, 2005

Related U.S. Application Data

(60) Provisional application No. 60/560,083, filed on Apr. 6, 2004.

(51) Int. Cl.
*A61G 7/10* (2006.01)
*A61G 7/053* (2006.01)

(52) U.S. Cl. ..... 5/83.1; 5/85.1; 5/81.1 R

(58) Field of Classification Search ..... 5/81.1 R–89.1; 414/921

See application file for complete search history.

(56) References Cited

U.S. PATENT DOCUMENTS 1,876,832 A * 9/1932 Bancroft ..... 5/89.1
3,222,029 A * 12/1965 Hildemann ..... 254/8 R
3,694,829 A * 10/1972 Bakker ..... 5/87.1
3,877,421 A * 4/1975 Brown ..... 601/23
3,940,808 A * 3/1976 Petrini ..... 5/83.1
4,065,179 A * 12/1977 Takasaki ..... 297/464
4,138,750 A * 2/1979 Michalowski ..... 5/89.1
4,221,011 A * 9/1980 Flinchbaugh ..... 5/89.1
4,232,412 A * 11/1980 Petrini ..... 5/83.1
4,387,473 A * 6/1983 Gettner ..... 5/85.1
4,399,572 A * 8/1983 Johansson ..... 5/87.1
4,446,587 A * 5/1984 Jump ..... 5/83.1
4,530,122 A * 7/1985 Sanders et al. ..... 5/83.1
4,571,758 A * 2/1986 Samuelsson ..... 5/83.1
4,606,082 A * 8/1986 Kuhlman ..... 4/561.1
4,639,955 A * 2/1987 Carminati et al. ..... 5/85.1
4,719,655 A 1/1988 Dean ..... 5/81 R
4,748,701 A * 6/1988 Marlowe et al. ..... 5/89.1
4,903,355 A * 2/1990 Hickerson ..... 5/83.1
4,947,497 A 8/1990 Marchand ..... 5/86
5,009,565 A 4/1991 Esau ..... 414/607
5,165,123 A 11/1992 Colpron ..... 5/83.1
5,355,538 A 10/1994 Fulford et al. ..... 5/86.1
5,379,468 A * 1/1995 Cassidy et al. ..... 5/86.1
5,388,289 A * 2/1995 Casperson ..... 5/86.1

(Continued)

*Primary Examiner*—Patricia Engle
*Assistant Examiner*—Jonathan Liu
(74) *Attorney, Agent, or Firm*—The Nath Law Group; Jerald L. Meyer; Matthew J. Moffa

(57) ABSTRACT

In a lift and transfer device and method, a patient support assembly supported on a lift on a wheeled platform includes a main support arm pivoted to the lift. First and second transversely extending support arms respectively carrying a back support section and a leg support are cantilevered from the main support arm. The main support arm is positioned for lifting the patient from a bed. The main support arm is rotated from a first to a second angular position for lowering a patient to a wheelchair. First and second pivot arms each have an upper end pivotally supported to the back support section and a lower end having a torso grip pad positioned adjacent one side of the patient. Horizontal force applied by each torso grip pad and friction provide patient support. Further device forms are provided for bariatric patients and for use with other types of lifts.

43 Claims, 14 Drawing Sheets

U.S. PATENT DOCUMENTS

| | | | | | |
|---|---|---|---|---|---|
| 5,499,408 | A * | 3/1996 | Nix | 5/85.1 |
| 5,560,054 | A * | 10/1996 | Simon | 5/86.1 |
| 5,692,253 | A * | 12/1997 | Keijser et al. | 5/83.1 |
| 5,729,843 | A * | 3/1998 | Manthey | 5/89.1 |
| 5,809,591 | A * | 9/1998 | Capaldi et al. | 5/83.1 |
| 5,987,664 | A * | 11/1999 | Somerton et al. | 5/86.1 |
| 6,092,247 | A | 7/2000 | Wilson | 5/86.1 |
| 6,192,534 | B1 * | 2/2001 | Restivo | 5/89.1 |
| 6,276,665 | B1 * | 8/2001 | Hawkins et al. | 254/8 B |
| 6,289,534 | B1 * | 9/2001 | Hakamiun et al. | 5/89.1 |
| 6,367,103 | B1 * | 4/2002 | Collins | 5/86.1 |
| 6,430,761 | B1 | 8/2002 | Brandorff | 5/86.1 |
| 6,557,189 | B2 * | 5/2003 | Von Schroeter | 5/86.1 |
| 6,637,610 | B1 * | 10/2003 | Cheeseboro | 212/327 |
| 6,675,412 | B2 * | 1/2004 | Faucher et al. | 5/83.1 |
| 6,718,573 | B2 * | 4/2004 | Von Schroeter | 5/86.1 |
| 6,806,430 | B2 * | 10/2004 | Downing | 177/144 |
| 2002/0038477 | A1 * | 4/2002 | Mowery | 5/86.1 |
| 2004/0130198 | A1 * | 7/2004 | Lingegard et al. | 297/325 |
| 2005/0273927 | A1 * | 12/2005 | Tally | 5/86.1 |

* cited by examiner

PATIENT LIFT AND TRANSFER DEVICE AND METHOD

CROSS-REFERENCE TO RELATED APPLICATIONS

This application claims priority to U.S. Provisional Patent Application Ser. No. 60/560,083 filed Apr. 6, 2004, the disclosure of which is incorporated herein by reference in its entirety.

FIELD OF INVENTION

The present invention subject matter relates to a device and method for lifting a patient in a first position in one location, transporting the patient to a second location, and depositing the patient at the second location in a desired position.

BACKGROUND OF THE INVENTION

A patient lift and transfer device is commonly known as a device that transports a patient who is in a first position at a first support. The patient may, for example, be in a supine position on a bed. The patient may be moved to a second support and positioned in a selected position which may be the same or different from the first position by such a patient lift and transfer device. For example, the patient may be moved to a wheelchair and deposited on the wheelchair in a sitting position. Commonly, the device is movable on wheels from a first location adjacent to the first support to a second location adjacent to the second support.

Typically, a number of operations must be performed to effect such a transfer, especially since the patient is often unable to assist the attendant or attendants performing the transfer. For example, in moving a patient from a bed to a wheelchair, the lift and transfer device typically must be moved to a position to interact with the patient on the bed. Support means must be interposed between the patient and the bed so that the patient can be lifted by the support means. The patient is then lifted from the bed so as to be movable free of engagement with the bed or any bed frame. The device is next wheeled to a position adjacent to the wheelchair. The patient must be lifted to a position above the wheel chair and lowered into it. The device must be formed to permit movement of the patient into engagement with the wheelchair without being blocked by elements of the wheelchair. Prior to this operation, the patient must be moved from the supine position to the sitting position. Once the patient is lowered into the wheelchair, the portions of the device between the patient and the wheelchair must be removed without undue discomfort to the patient.

In many common prior art embodiments, the above-described operations require the services of two attendants, and may require as many as eight minutes for their performance. In the context of hospitals and nursing homes, it is very important to reduce labor requirements wherever possible. Facilities face significant budget constraints. The current levels of staffing for a ward or a facility give each nurse or other attending staff member only so many minutes per patient per shift. Accordingly, reducing the labor effort required for patient transfer would be expected to enable a higher level of patient service for a given budget.

In the case of home health care, a patient might have only a single aide on duty. Performing a transfer that requires two attendants requires making special arrangements with a care provider agency to provide a second aide to accomplish the transfer. The requirement for a second aide can mean the difference for a patient between being able to be home and having to be institutionalized. Accordingly, it is highly desirable to provide a lift and transfer device that can be reasonably operated by a single person.

The well being and longevity in service of health care personnel is adversely affected by these difficulties in the physical handling of patients. According to a United States Department of Defense Study, nursing is a high-risk occupation, second only to heavy industry, because the high volume of lifting patients every day leads to fatigue, muscle strain, and injury. The study states that 12% of nurses leave the profession each year due to chronic or acute back injuries and pain. According to nursing literature, there is no ergonomically safe way to lift patients. The weight of an adult patient exceeds tolerance limits set by the NIOSH (National Institute for Occupational Safety and Health) for compressive forces to the lumbar spine. Accordingly, devices that provide for ease of patient handling, particularly when only one attendant is available, can increase the quality and availability of nursing service by helping to reduce the number of experienced health care providers who need to leave the profession.

Other significant concerns in lifting and transferring patients are the comfort and security of the patient. In order to lift a patient, many prior art devices use different types of slings which are each supported on a lift. A body sling is used to support a patient's entire body. The sling is lifted and moved to transport the patient. However, the use of such body slings has many common downsides. For example, even when the body sling has more than one support point, the sling may tend to rock. Rocking causes a feeling of insecurity to the patient. Further, it is difficult to center the patient in a sling so that the patient's body will not slide along the surface of the sling to reach a position of equilibrium. Many patients have fragile skin, and even the limited abrasion caused by normal sling materials and minimal patient sliding can cause skin tears.

Another currently available sling is an elongated, wide strip anchored at a first end to a lift support point. The sling is brought under a first armpit of the patient, around the patient's back, below a second armpit and back to the front of the patient. A second end of the sling is fixed to the lift support point. During lifting, the sling applies a significant portion or all of the patient's weight to the patient's armpits. Accordingly, the sling can cut into the patient and cause great discomfort, which it is highly desirable to minimize. Further, this pressure to the underarms can impede blood flow and lead to undesirable effects. Such devices may also cause the patient emotional as well as physical discomfort since the patient may feel insecurity while suspended in midair.

Other previous devices for patient transfer provide a structure that will support the patient during the transfer process and through the lowering of the patient into the wheel chair or other second location. In prior art devices with back and buttocks support for the patient, reliable support is provided during the transfer process. However, once the patient is in the second location, the supports are still in place between the patient and the wheelchair. The patient must be leaned forward to allow removal of the back support. Other manipulation must be performed to remove the support from between the patient and the wheelchair seat. Each manipulation of the patient that must be performed may increase discomfort to the patient. Where the patient is fragile, each manipulation additionally presents a risk of injury. It is highly desirable, then, to provide a transfer device in which the amount of manipulation of a patient in a second location is minimized in order to remove the transfer device.

Prior art transfer devices are also not widely available for bariatric patients. Bariatrics is a branch of medicine specializing in the treatment of overweight and obesity. Many bariatric patients weigh 350 to 750 pounds. A number of nursing homes limit the weight of patients they will admit to 300 pounds. One reason for this is the difficulty in handling patients over 300 pounds. A transfer device adaptable to bariatric patients would enable a wider range of patients to be served and provide a competitive advantage to health care providers using them.

Accordingly, there remains a need in the art for an alternative device and method for patient lift and transfer that solves these problems. The present subject matter addresses this need.

SUMMARY OF THE INVENTION

In accordance with the present subject matter, a lift and transfer device is provided in which a single operator can transfer a patient from one location to another location with minimal patient manipulation while providing a high level of comfort and security to the patient. The device in one form includes a wheeled base which may be wheeled in a transverse direction under, for example, a bed to be positioned at a first location. A lift is supported at a side of the base to be transversely adjacent to the bed when substantially the remainder of the base is under the bed. A patient support assembly supported on the lift has first and second transversely extending support arms cantilevered from a longitudinally extending main support arm pivotally supported on the lift. The first support arm carries a back support section which supports a back and other parts of the body. The second support arm carries a leg support section which supports a patient under and behind the knees. The patient is supported while leaving the lower torso, buttocks and thighs substantially free.

In a first angular position, the main support arm supports the backrest so that a patient's weight is applied to the back support section in a substantially vertical direction. This position is suitable for lifting the patient from a bed. The main support arm is rotated to a second angular position and lifted so as to be positionable above, for example, a wheelchair in a second location. In the second angular position, the patient's back is more vertically than horizontally disposed. In this position, horizontal force can be applied to the sides of the patient. Where the horizontal force is applied in response to gravity, first and second pivot arms each have an upper end pivotally supported on the back support section and a lower end having a torso grip pad positioned adjacent one of the patient's sides. An elbow support, which may also include a forearm support, is provided along with each torso grip pad. The support provides for comfortable placement of the patient's arms and is arranged to bear weight but not enough to cause discomfort to a patient. Reaction of body weight against the back support section is shared by the back, rib cage and elbows and/or forearms. The leg support section shares body weight support.

As the patient is rotated to the more generally vertical position, the predominant reaction of the device to body weight transitions from the backrest to the torso grip pads. The angular orientation of the pivot arms enables a direct interaction of vertical and horizontal forces at the torso grip pads. The vertical body weight loads applied to the grip pads are directly countered by a horizontal reaction force from the patient's rib cage. These horizontal forces are sufficiently large that when coupled with friction they are capable of supporting substantial portions of body weight. The horizontal force applied to the patient varies as a function of both patient body weight and of angular displacement of a respective pivot arm from the vertical axis. The resultant forces applied to each of the patient's sides by the pivot arms are consequently self-adjusting.

A desired range of angular displacement is selected for each pivot arm with respect to a nominal range of patient dimensions. The normal force applied by each torso grip pad times the coefficient of friction is typically greater than approximately one half the body weight of the patient not otherwise supported. A vertical weight support means comprising means for providing a vertical reaction to forces vertically applied by the body of the patient may be used in conjunction with the pivot arms to provide for positive support in the case of bariatric and other applications.

The patient is raised to a height to be positionable above a wheelchair in a second location and lowered into the wheelchair. In an alternative form, the lift and transfer device may comprise a lift which is supported to a bed frame structure, i.e. connected directly to the frame structure or coupled by an intermediate member. In another alternative form, the lift may be an overhead lift. In these embodiments, the transfer means are rotated in a horizontal degree of freedom from one location to a next rather than being wheeled.

Since there is not a support structure below the patient's buttocks, no manipulation must be done to the patient to allow seating in the wheelchair or in another second location. The pivot arms may be swung away from the patient's body, and the device may be wheeled transversely to remove the backrest and knee support from engagement with the patient. Minimal manipulation of the patient's arms is required.

Further, the methods contemplated herein comprise moving the patient from a first location to a second location and applying horizontal force to the patient's torso as a function of the verticality of the patient's spatial disposition when moving the patient from a first position to a second position.

BRIEF DESCRIPTION OF THE DRAWINGS

Embodiments of the invention are described with reference to the following drawings.

DETAILED DESCRIPTION

Figure 1:
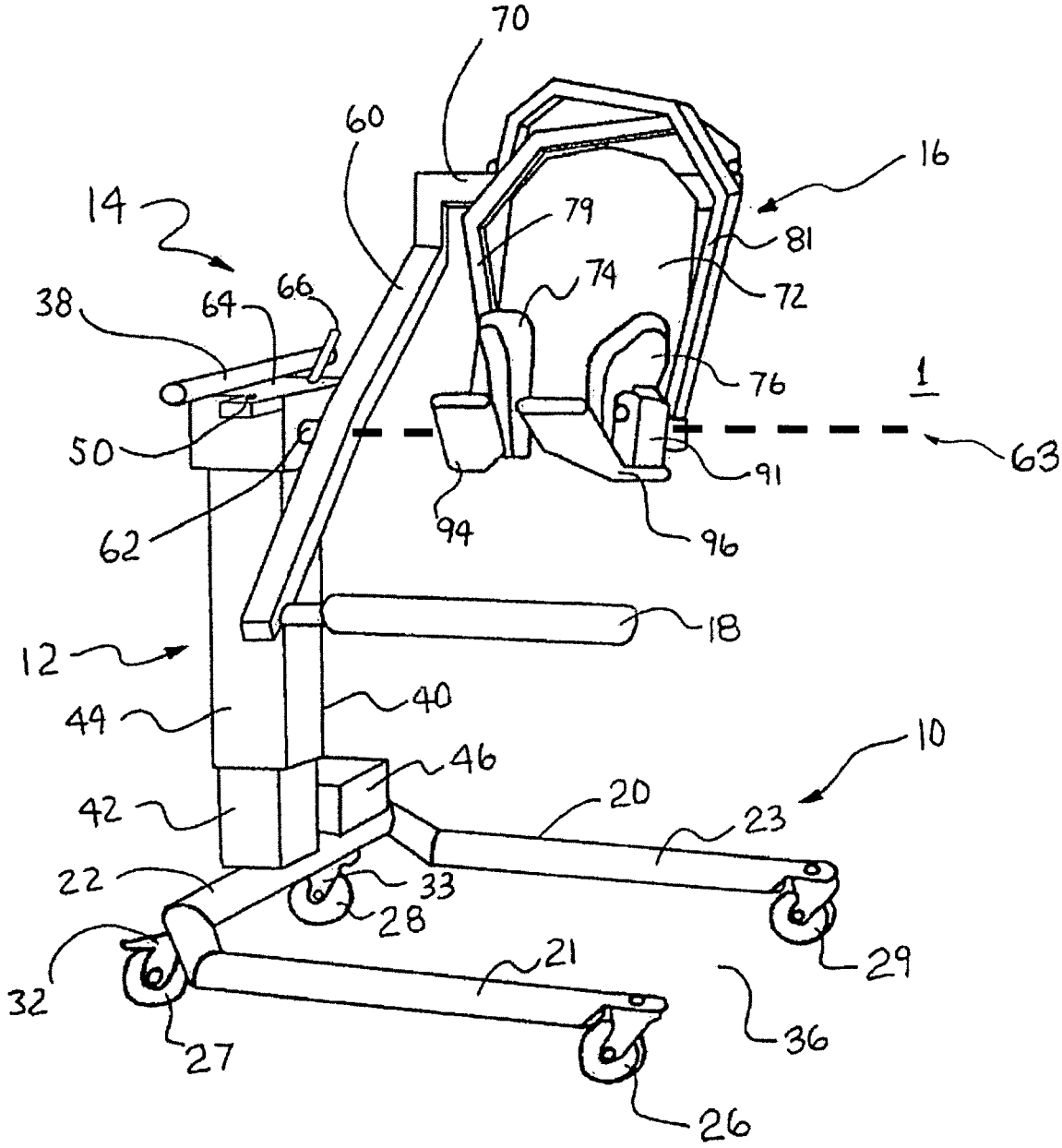
FIG. 1 is an axonometric view of a lift and transfer device constructed in accordance with the present subject matter.

FIG. 1 is an axonometric illustration of a patient lift and transfer device 1 constructed in accordance with the present subject matter. The device 1 transfers a patient 2 (FIG. 5) from a first location to a second location as further illustrated below with respect to FIGS. 8-11. The patient 2 may be in a first position, e.g., resting on a bed, at the first location and shifted to a second position, e.g., sitting, for transfer to the second location. The resting position could be the supine position. Alternatively, the patient 2 could have a back tilted upwardly and the knees could be raised. The lift and transfer device 1 includes a transport section 10 which achieves movement from the first location to the second location. The lift and transfer device 1 is moved by an operator to engage the patient 2 while the patient 2 is supported on a support device, e.g. a bed, a wheelchair, or a toilet. A lift section 12 raises and lowers the patient 2 onto or off of the support device. A patient handling section 14 supports the patient 2 and angularly moves the patient 2 from one position to another. The patient handling section 14 includes a back support section 16 and a leg support section 18 comprising a leg support. The term "back support" is utilized to refer to support of a particular area of the body. As further described below, the back support section 16 does not interact only with the back of a patient 2.

In the present embodiment, the transport section 10 comprises a wheeled platform 20. The platform 20 includes substantially parallel legs 21 and 23 extending transversely from opposite ends of a longitudinally disposed leg 22. The transverse and longitudinal designations are arbitrary; they serve to describe relative spatial relationships within the lift and transfer device 1. Wheels 26 and 27 are mounted beneath a distal end of the leg 21 and a proximal end of the leg 21 respectively. In the present description, proximal refers to a location adjoining the leg 22. Wheels 28 and 29 are mounted beneath a proximal end and a distal end of the leg 23 respectively. The wheels 26-29 are mounted on swivel mounts to facilitate ease in directing the device 1. The wheels 27 and 28 are preferably provided with conventional wheel locks 32 and 33 respectively to permit fixing the device 1 at a location. A preferred construction for the platform 20 is welded tubular stock. This form of platform 20 is both stiff and lightweight.

The platform 20 in one nominal embodiment has a height of four inches. The platform 20 is easily slidable under a hospital bed so that the patient handling section 14 may be conveniently placed over the bed. The legs 21 and 23 are spaced in the longitudinal dimension so that they may surround a wheelchair. The legs 21, 22, and 23 form a U, with the open top of the U extending in the longitudinal direction. Consequently, the patient handling section 14 may be moved conveniently to and from a location over a wheelchair from the side of the wheelchair. A handle 38 fixed to a top of the lift section 12 may be used to transmit manually applied motive force to the device 1. The legs 21, 22 and 23 define a rectangle 36. The components further described below are dimensioned so that the center of gravity of the device 1 with or without the patient 2 carried therein is placed substantially near a center of the rectangle 36 to provide for stability.

The lift section 12 comprises a well-known electrically driven lift 40 mounted to the leg 22. The lift 40 comprises a fixed column 42 mounted to the leg 22. The fixed column 42 includes conventional gearing and an electric motor to raise and lower a sliding linear column 44 mounted over the fixed column 42. The lift 40 is powered by a 24 volt battery/charging system 46 mounted to the leg 22 adjacent to the lift 40. A control switch 50 is mounted to the top of the lift 40. The control switch 50 is operable in a conventional, well-known manner to operate the lift 40 in a raise, lower or off mode.

The patient handling section 14 comprises a main support arm 60 extending in the longitudinal direction. The main support arm 60 rotates on a support shaft 62 journaled in a clutch 64. The clutch 64 is mounted at a top of the lift 40. A clutch control lever 66 is operable in a first position to lock the clutch 64 and prevent rotation of the support shaft 62 and in a second position to permit rotation of the support shaft 62. Alternatively, the clutch 64 could be replaced by a friction drag. A friction drag provides for ease in rotation of the support shaft 62 while securing the support shaft 62 in an angular position when a force is not applied by an operator to the main support arm 60. The main support arm 60 may be disposed in a first position or a second position corresponding respectively to first and second positions of the patient 2.

Figure 12:
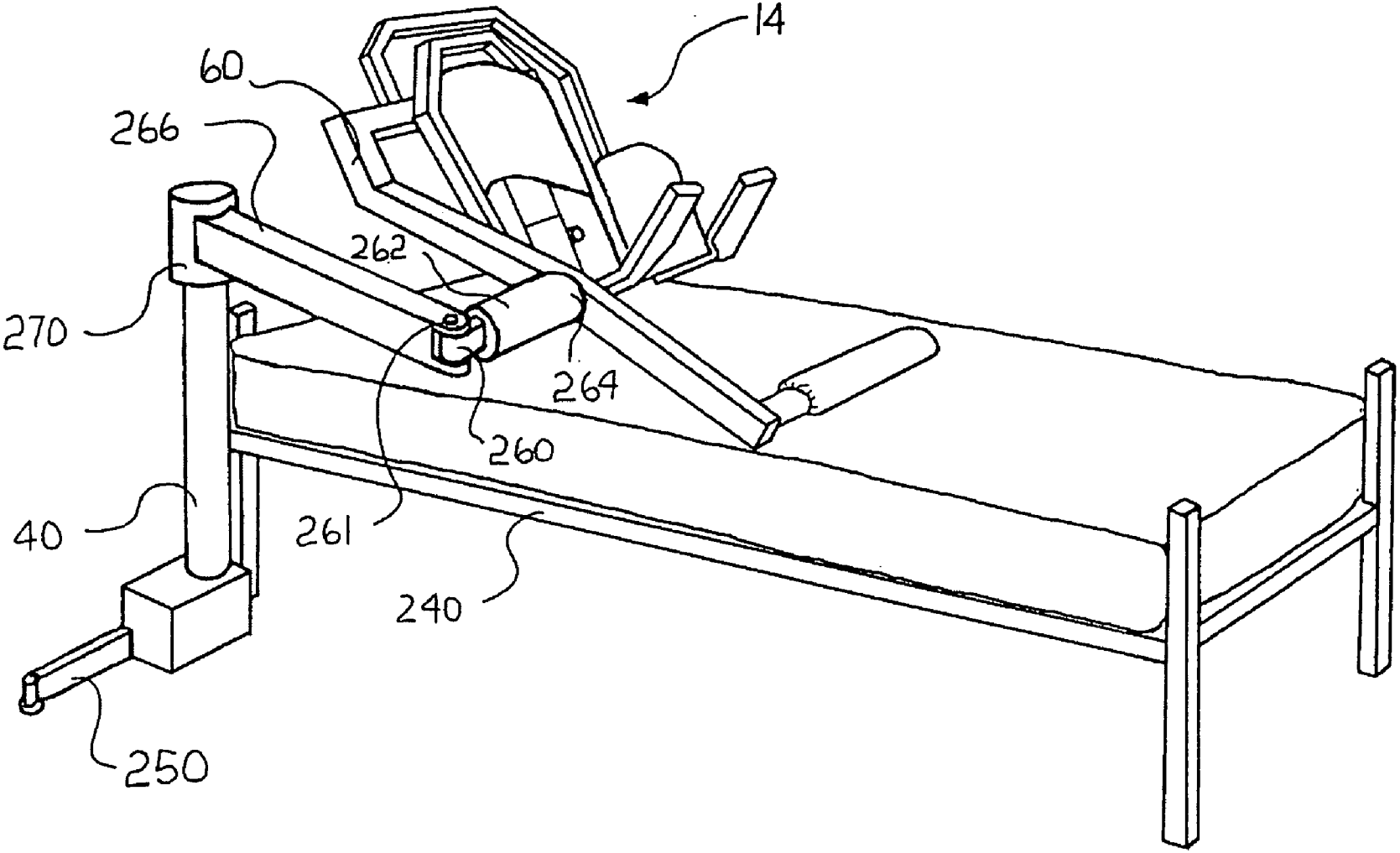
FIG. 12 is an axonometric illustration of an embodiment which can be supported to a bed frame rather than on a wheeled base.

The main support arm 60 may be straight. Alternatively, it may comprise bends for selecting a relative position of the back support section 16 with respect to the leg support section 18. The system is dimensioned so that the vertical location of the support shaft 62 approximates that of the center of gravity of the patient handling section 14 including a patient 2. Thus, the main support arm 60 may rotate about a horizontal axis 63 extending through a space occupied by a patient when in the device (a "patient position"). Otherwise stated, the main support arm 60 is pivoted about a balance point in spatial registration with an expected center of gravity of a patient and pivoted elements of said device. Since the patient 2 is substantially balanced, an operator may tilt the main support arm 60 with a limited amount of effort. No motor is needed to rotate the main support arm 60, and construction is simplified. However, while a balance point may be selected that will conveniently accommodate a wide range of patients, bariatric patients may have weight distributed such that an operator may have difficulty rotating the main support arm 60. Also, variation in the location of the center of gravity of a bariatric patient may create force moments beyond the restraining capacity of the friction drag. For such situations, the clutch 64 or friction drag may be replaced by a motor to provide for powered rotation. An embodiment including a motor is illustrated in FIG. 12 below.

Figure 2:
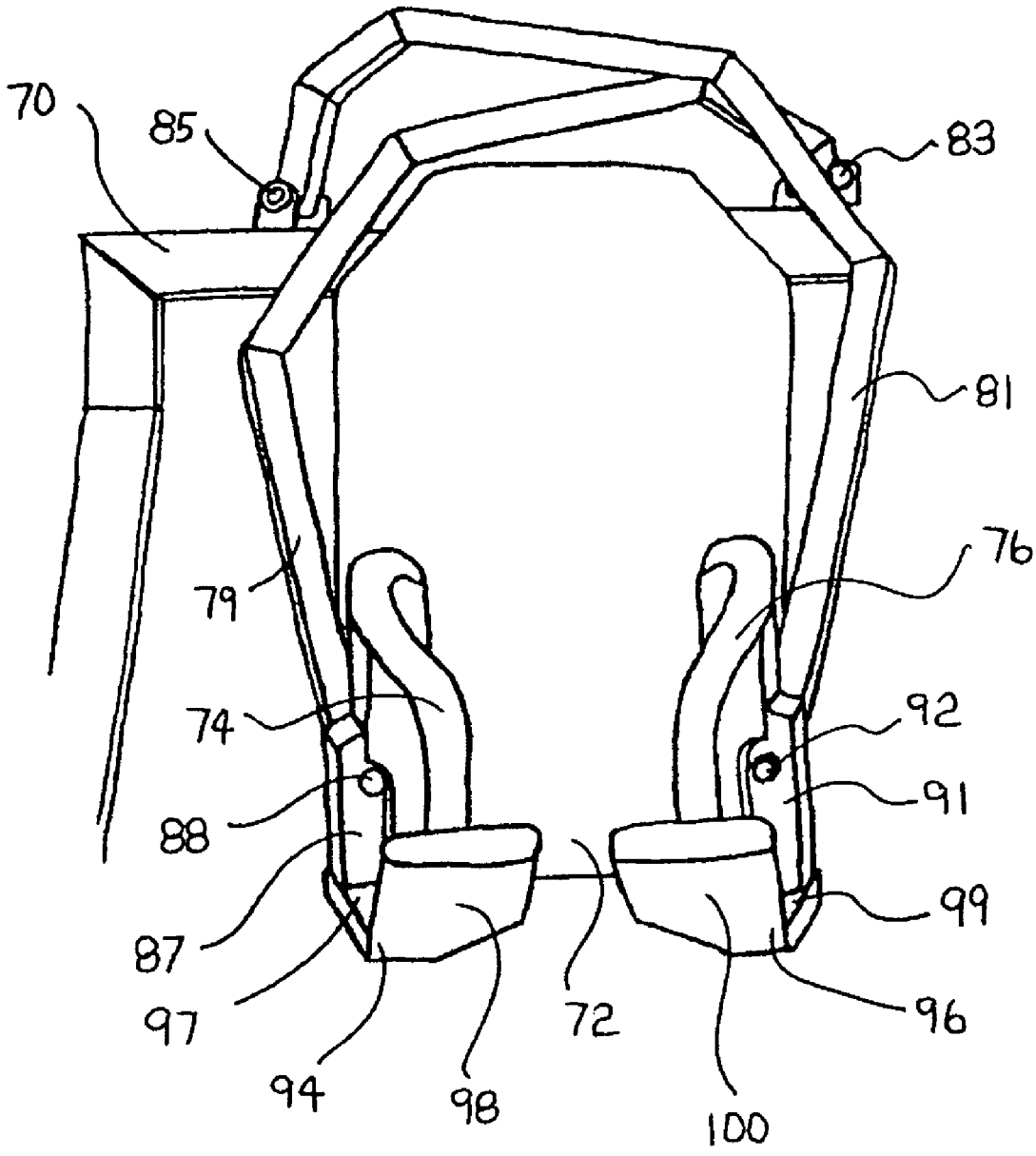
FIG. 2 is a front elevation of the back support section.
Figure 3:
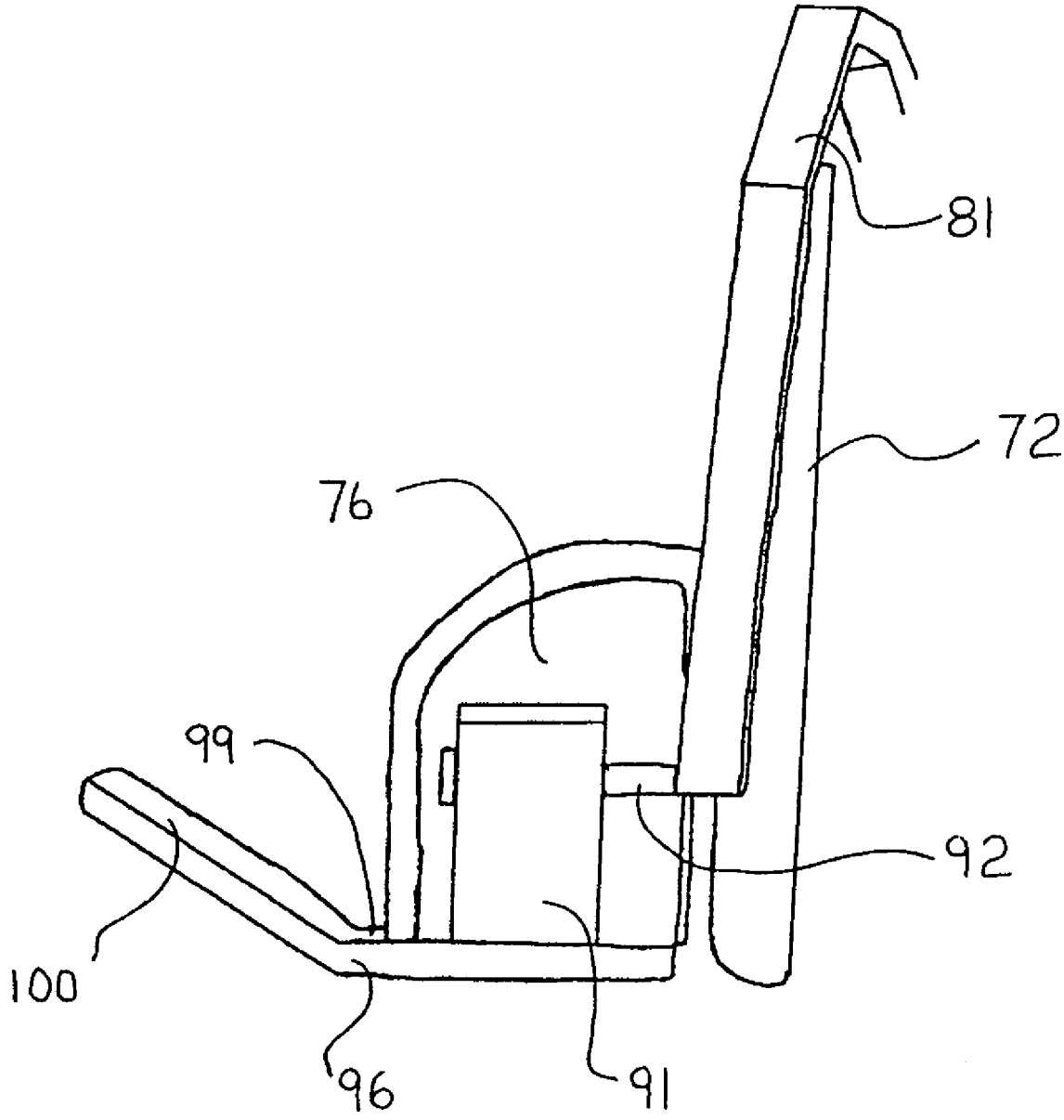
FIG. 3 is a side elevation of the back support section
Figure 4:
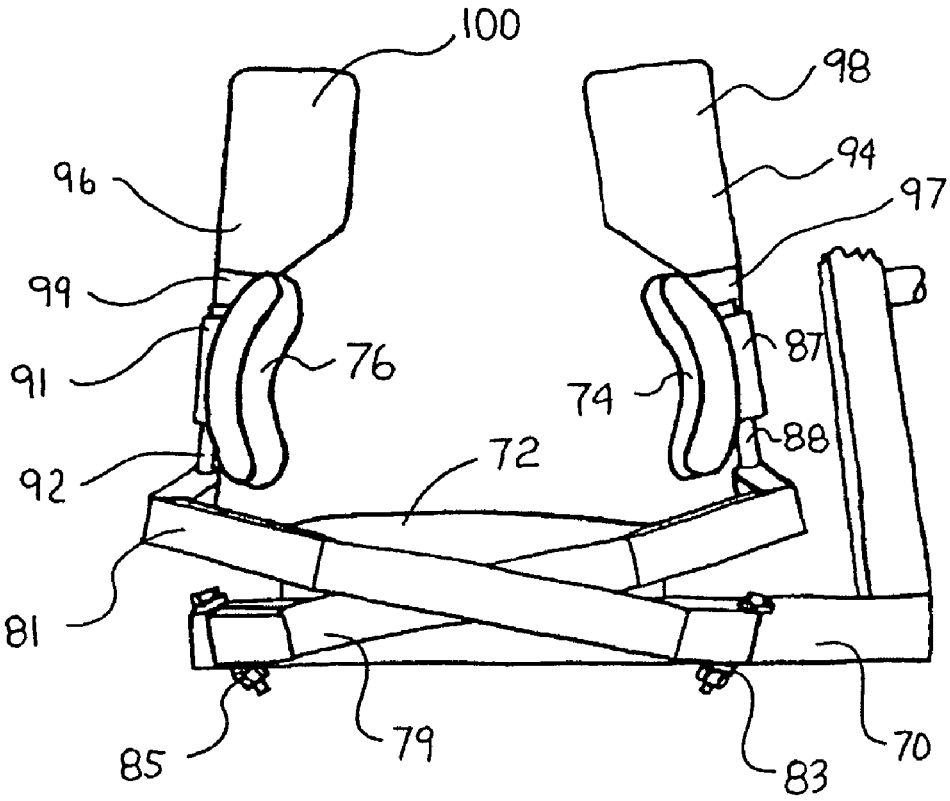
FIG. 4 is a plan view of the back support section.

The back support section 16 is further described with respect to FIGS. 2, 3, and 4, as well as with respect to FIG. 1. FIGS. 2 and 3 show a front elevation and a side elevation of the back support section 16, respectively. FIG. 4 shows a plan view. A back support arm 70 extends transversely from a first end of the main support arm 60. A backrest 72 is "supported to" the back support arm 70, i.e. the backrest 72 may be supported directly on the support arm 70 or may be coupled thereto by one or more intermediate members. The phrase "supported to" as used herein further has the same meaning as applied to components of the present apparatus other than the backrest 72 or support arm 70. A torso support provides predominant support when said main support arm 60 is in the second position. Forms of the torso support may or may not provide significant force to the patient 2 when the main support arm 60 is in the first position. The torso support comprises means for applying horizontal force to sides of the patient 2.

Figure 5:
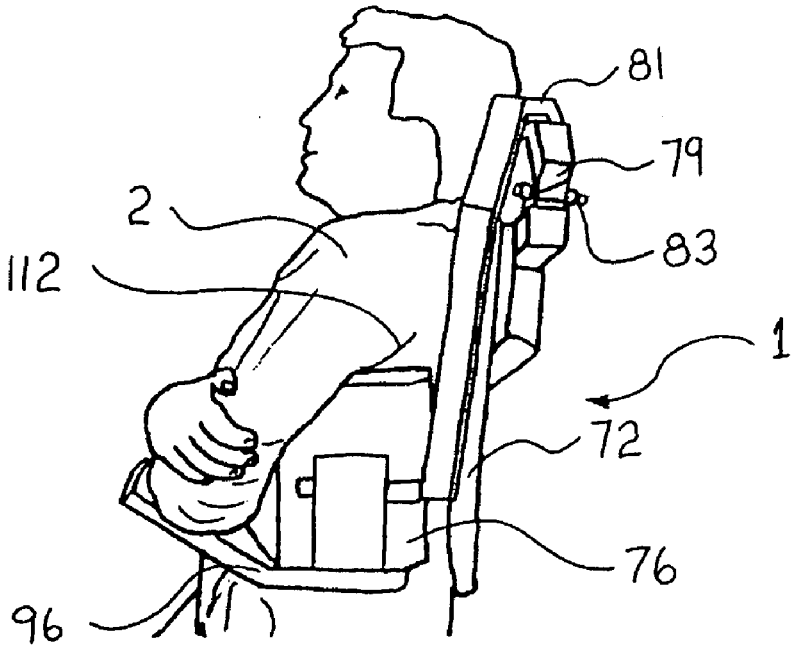
FIG. 5 is a partial detailed side elevation illustrating engagement of a patient in a back support section.

Such means for applying horizontal force to the patient 2 comprise first and second torso grip pads 74 and 76. The first and second torso grip pads 74 and 76 engage a proximal side and a distal side of the patient 2 (FIG. 5). Again, proximal and distal sides are referenced with respect to the platform leg 22, which is also the location of the lift 40, and are at the left and right sides of the backrest 72 as viewed in FIGS. 1 and 2. In a preferred form, the horizontal force is supplied in response to gravity. In order to provide horizontal force in this manner, the first and second torso grip pads 74 and 76 are supported on first ends of pivot arms 79 and 81, respectively. The operation of the torso grip pads and pivot arms 79 and 81 is explained with respect to FIG. 6 below. Other means for applying horizontal force to the patient 2 may supply horizontal force to the first and second torso grip pads 74 and 76. The horizontal force could be applied, for example, through a spring system, a hydraulic/pneumatic system or a linear actuator system. One form of spring system useful in this regard could comprise an arrangement in which an attendant presets the patient's weight with a dial system. The dial system is coupled to operate linkages to adjust the compressive force supplied by the spring. The attendant then releases the spring to bias the torso grip pads 74 and 76 by a lever system.

Another alternative to having torso grip pads 74 and 76 mounted to pivot arms is the use of wedge members that bear against the sides of a patient 2. The wedge members can each be mounted to an adjustable support, and an attendant can manually set the position of each wedge against the sides of the patient 2. This alternative will apply horizontal force the patient 2 when the patient 2 is in either the first position or the second position. In contrast, the embodiment including pivot arms will primarily apply horizontal force only when the patient 2 is in the second position.

The first and second torso grip pads 74 and 76 are curved with an anatomical contour approximating a patient torso shape for greater surface area of contact than a flat pad. The first and second torso grip pads 74 and 76 are padded to permit deformation to conform to a patient's contour, providing for uniform load distribution and for greater comfort. Second ends of the pivot arms 79 and 81 are mounted to pivot supports 83 and 85 respectively.

The first torso grip pad 74 has extending from an outside surface (away from the patient 2) thereof a first support block 87. The first support block 87 is pivotally mounted on a first longitudinal arm 88 extending from the first end of the pivot arm 79. Similarly, the second torso grip pad 76 has extending from an outside surface thereof a second support block 91. The second support block 91 is pivotally mounted on a second longitudinal arm 92 extending from the first end of the pivot arm 81. The first and second support blocks 87 and 91 are preferably unitary with the first and second torso grip pads 74 and 76 respectively. The first and second torso grip pads 74 and 76 are consequently self-adjusting to engage sides of the patient 2. The first and second torso grip pads 74 and 76 impart a large and balanced force against the sides of the patient 2. As further explained with respect to FIG. 6, below, this force coupled with friction holds the body of the patient 2 in place.

In the present example, pivot supports 83 and 85 are mounted to the back support arm 70. Many different arrangements may be provided for location of the pivot supports 83 and 85 and for the shape of the pivot arms 79 and 81. The pivot arms 79 and 81 are pivoted so that the first and second torso grip pads 74 and 76 provide compressive force against the torso of the patient 2. In the present embodiment, the pivot supports 83 and 85 are located so that the arcs of the pivot arms 79 and 81 intersect. In order to avoid interference, the pivot arms 79 and 81 are pivoted at a location behind the backrest 72 and extend to a position in front of the backrest 72. "Behind" and "in front of" are used here with reference to a direction in which the patient 2 will be facing when engaged in the device 1. The pivot arms 79 and 81 extend in both the longitudinal and transverse degrees of freedom. The pivot arms 79 and 81 are curved to extend around the backrest 72. The pivot arm 81 is located to be fully rotatable around the pivot support 83 free of engagement with the pivot arm 79. Therefore the distal side of the patient 2 can be completely cleared. Once the pivot arm 81 is swung away from the patient 2, the pivot arm 79 can be swung. Alternatively, the pivot supports 83 and 85 could be located next to each other at the back of the backrest 72, and the pivot arms 79 and 81 could swing in independent arcs. However, this would allow for a smaller angle between a vertical axis and a line from a pivot support 83 or 85 to a torso grip pad 74 or 76. Significance of this angle is described with respect to FIG. 6 below.

In the above example, only the lift 40 has been illustrated as being motorized. In a wide range of applications, operators employing the lift and transfer device 1 may not desire powered movement of components other than the lift 40. However, power articulation may be utilized wherever desired. For example, the clutch 64 could be replaced by a motor drive to rotate the main support arm 60. Selected ones of the wheels 26-29 may be powered. Motor assist or hydraulic cylinder assist could be used in rotating the first and second pivot arms 79 and 81. The device 1 as illustrated is adapted to approach a hospital bed from the patient 2's right side. The device 1 could be constructed to approach a bed from the patient 2's left side by having the leg 22 extend over the wheels 26 and 29 rather than the wheels 27 and 28 (FIG. 1). Also, the support shaft 62 would extend in an opposite transverse direction from the lift 40. The back support arm 70 and the leg support section 18 would extend from the main support arm 60 in an opposite transverse direction.

First and second arm support units 94 and 96 are supported on the pivot arms 79 and 81 respectively. In the present embodiment, they are supported on the pivot arms 79 and 81 by being supported on lower ends of the first and second torso support blocks 87 and 91, respectively. The first and second arm support units 94 and 96 may also be unitary with the first and second torso grip pads 74 and 76, respectively. The first and second arm support units 84 and 96 may be made vertically adjustable with respect to the pivot arms 79 and 81, respectively. In another form, arm support units may be supported directly to pivot arms, for example, as in the embodiment of FIG. 13 discussed below.

The first arm support unit 94 includes an elbow support 97 supported on the first support block 87 and has a first forearm support 98 extending from the elbow support 97 and canted upwardly. Similarly, the second arm support unit 96 may include an elbow support 99 supported on the second support block 91. A second forearm support 100 may extend from the elbow support 99 and be canted upwardly therefrom. While pointed portions of the elbows may bear weight directly, it is desirable to provide cushioned support to the patient 2 in the elbow region to resist the force of gravity. The elbow region for purposes of the present description is an area near the elbow and toward the hand. The elbow region may be centered three or four inches from the elbow.

This support facilitates application of force to be transmitted through bones of a patient 2 so that the shoulders help carry weight. Force is transmitted from the elbow region through the humerus (elbow-to-shoulder bone) to the shoulders.

The forearm supports 98 and 100 are pivotally mounted about the longitudinal arms 88 and 92, respectively. Therefore, it is preferable to make a centroid of area of the first forearm support 98 substantially collinear with the first longitudinal arm 88. Similarly, a centroid of area of the second forearm support 100 is collinear with the second longitudinal arm 92. The collinear placement prevents exertion of a force moment on the first and second torso grip pads 74 and 76 from the first and second forearm supports 98 and 100. There may be embodiments in which the forearm supports 98 or 100 may be mounted directly to the first or second longitudinal arms 88 or 92 respectively. It is not necessary for the first and second forearm supports 98 or 100 to be unitary with the first or second torso grip pads 74 or 76.

FIG. 5 is a partial detailed side elevation of a patient 2 in the back support section 16 of the device 1. The first torso grip pad 74, as seen in FIG. 5, and the second torso grip pad 76 engage the patient's torso 110. The torso grip pads 74 and 76 engage the torso 110 below armpits 112. Since, as explained with respect to FIG. 6, force supporting the patient 2 in a sitting position is primarily compressive force, significant upward force is not applied to the armpits 112 as in the case of prior art sling arrangements. The arm support units 94 and 96 are strategically located to prevent application of force to the armpits 112. Natural arm positioning is promoted. Partial body weight is carried by natural wedging that occurs between the arm support units 94 and 96 and the backrest 72. This wedging may be visualized by regarding the elbows, shoulders and the waist of the patient 2 as a triangle.

In preferred examples of the present embodiment, the arm support units 94 and 96 may together carry thirty percent of upper body weight. The potential for patient discomfort is therefore minimized. Since no strap, for example a prior art sling, is constricting a body part, the potential for impeding blood flow is also minimized.

Figure 6:
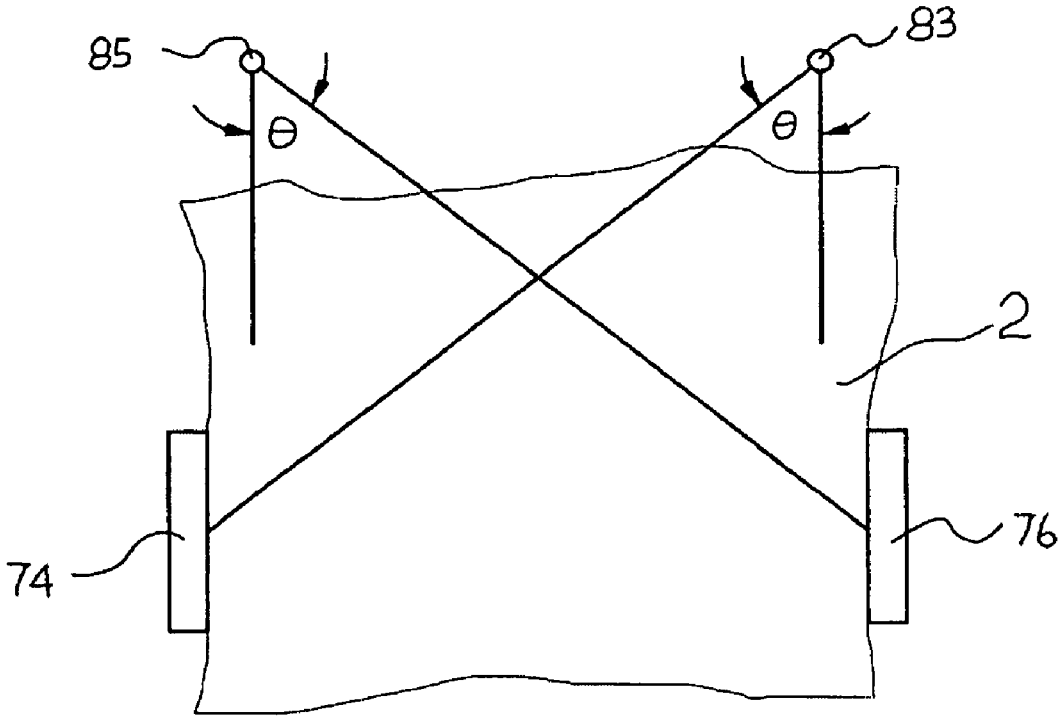
FIG. 6 is a vector diagram illustrating application of horizontal force to a patient's torso as a function of vertical load.

FIG. 6 is a diagram illustrating application of force to the torso 110 of a patient 2. The first and second pivot arms 79 and 81 and the pivot supports 83 and 85 are illustrated in schematic form. The effective angle with respect to the vertical at which a pivot arm 79 or 81 is disposed is determined by a line from the pivot supports 83 or 85 to a point approximating a center of contact of torso grip pad 74 or 76. This angle is referred to as θ. The horizontal force F applied by each torso grip pad 74 or 76 is given by:

$$F=(\text{weight})\tan\theta$$

where weight is the amount of the patient's weight supported by the given torso grip pad 74 or 76. The value of the tangent of θ increases with the value of θ. By choosing to position the pivot supports 83 and 85 transversely away from their corresponding torso grip pads 74 and 76, the value of θ is increased. This difference in relative transverse positions can be varied when designing the back support section 16 to provide a compressive force on the patient 2 which is sufficient to support the patient 2 with a feeling of security and yet not sufficient to cause discomfort in a patient who is not unusually fragile. In this arrangement, reaction of body weight against the lift device 1 is shared by the back, rib cage and forearms in the vicinity of the elbow and by the knees.

As the patient 2 is rotated to a more generally vertical position, the vertical component of force applied by the backrest 72 decreases. The vertical force applied by the patient's body at the interface of the patient's torso 110 and each torso grip pad 74 and 76 increases. Due to friction between each of the torso grip pads 74 and 76 and the patient 2 and/or the patient's clothing, there is effectively a contact point between the patient 2 and each torso grip pad 74 and 76. At this contact point, there is an interaction of vertical and horizontal forces. The normal, or horizontal, force applied by each torso grip pad 74 or 76 times the coefficient of friction is greater than approximately one half the body weight of the patient 2 not otherwise supported. The horizontal force applied to the patient 2 varies as a function of patient body weight and an angular displacement of a respective pivot arm 79 or 81 from the vertical axis. The resultant forces applied to each of the patient's sides by the first and second pivot arms 79 and 81 are consequently self-adjusting. A desired range of angular displacement is selected for each pivot arm 79 and 81 with respect to a nominal range of patient dimensions. While a wide range of patients 2 will encounter no discomfort or ill effect due to the compression of the torso 110 by the pivot arms 79 and 81, it may be undesirable to position particularly brittle patients 2 in the back support section 16.

Figure 7:
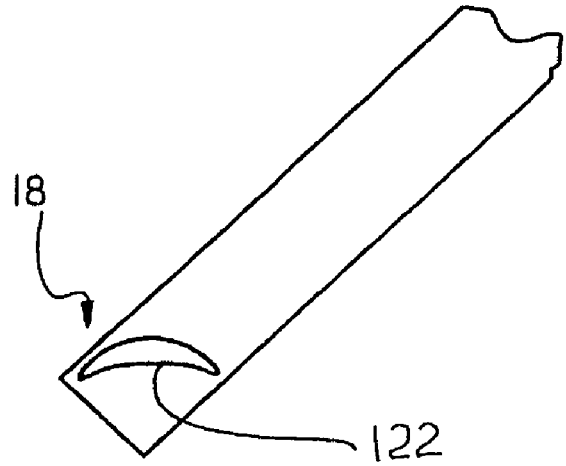
FIG. 7 is an elevation of a leg support section.

FIG. 7 is an elevation of the leg support section 18 and the main support arm 60. The leg support section 18 comprises a leg rest 122 extending transversely from the main support arm 60. The leg rest 122 is dimensioned to provide a transverse extent which will receive a range of patients of foreseeable sizes. The leg rest 122 supports a patient 2 below the knees. In the present example, the leg rest 122 comprises a member 124 having a cross section in the longitudinal dimension that is referred to for purposes of the present description as a segment. A segment is shaped generally like a segment of a circle. A portion of the member 124 positioned to contact the back of the knees of a patient 2 and comprises an upper surface of a segment of a circle that has a radius of curvature that will provide a comfortable rest for the back of the knees of a patient 2. An opposite surface of the member 124 is shaped to provide minimal interference with a wheelchair. The opposite surface may comprise a chord of the circle segment. However, the opposite surface could be indented or bowed with respect to the path of a chord. In the illustrated embodiment, the opposite surface is indented. The cross section of the member 124 is a crescent. Since the crescent shape does not have a volume that extends in a full circle, the volume of the leg rest 122 that could interfere with elements of wheelchairs is minimized.

A single location of the leg support section 18 on the main support arm 60 in relation to the back support section 16 will accommodate patients over a range of heights. Taller patients will bend their legs at a greater angle with respect to their torsos than will shorter patients. Further forms of the main support arm 60 useful in accommodating a wider range of patient sizes are described with respect to FIGS. 15 and 16 below.

Figure 8:
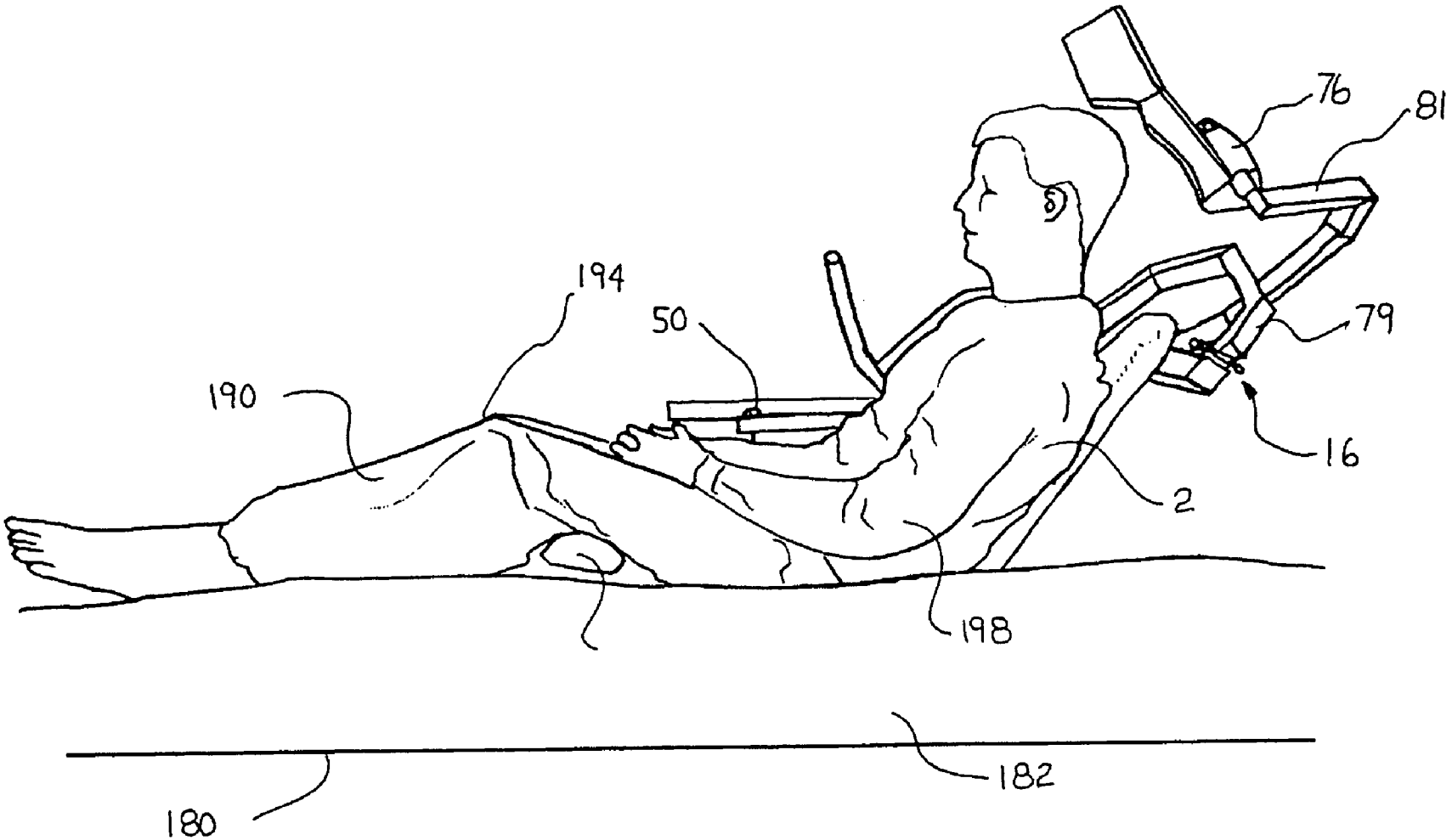
FIGS. 8-11 are illustrations showing a patient being moved from a first location in a first position to a second location in a second position.

FIGS. 8-11 are illustrations of steps in lifting and transferring a patient 2 from a first location to a second location and moving the patient 2 from a first position to a second position. As seen in FIG. 8, the lift and transfer device 1 is moved in a transverse direction so that the platform 20 is beneath a hospital bed 180. The patient is in a first position on a mattress 182 of the hospital bed 180. The pivot arms 79 and 81 are rotated to their positions away from the backrest 72. A patient 2 is brought to a sitting position. The backrest 72 is placed behind the torso 110 by moving the transfer and lift device 1 transversely. Legs 190 of the patient are bent so that as the platform 20 is wheeled under the hospital bed 180, the leg support section 18 moves below knees 194 of the patient. Arms 198 of the patient 2 will be (FIG. 9) crossed over the patient's chest. The pivot arms 79 and 81 are rotated to bring the first and second torso grip pads 74 and 76 in contact with the torso 110 of the patient 2.

Figure 9:
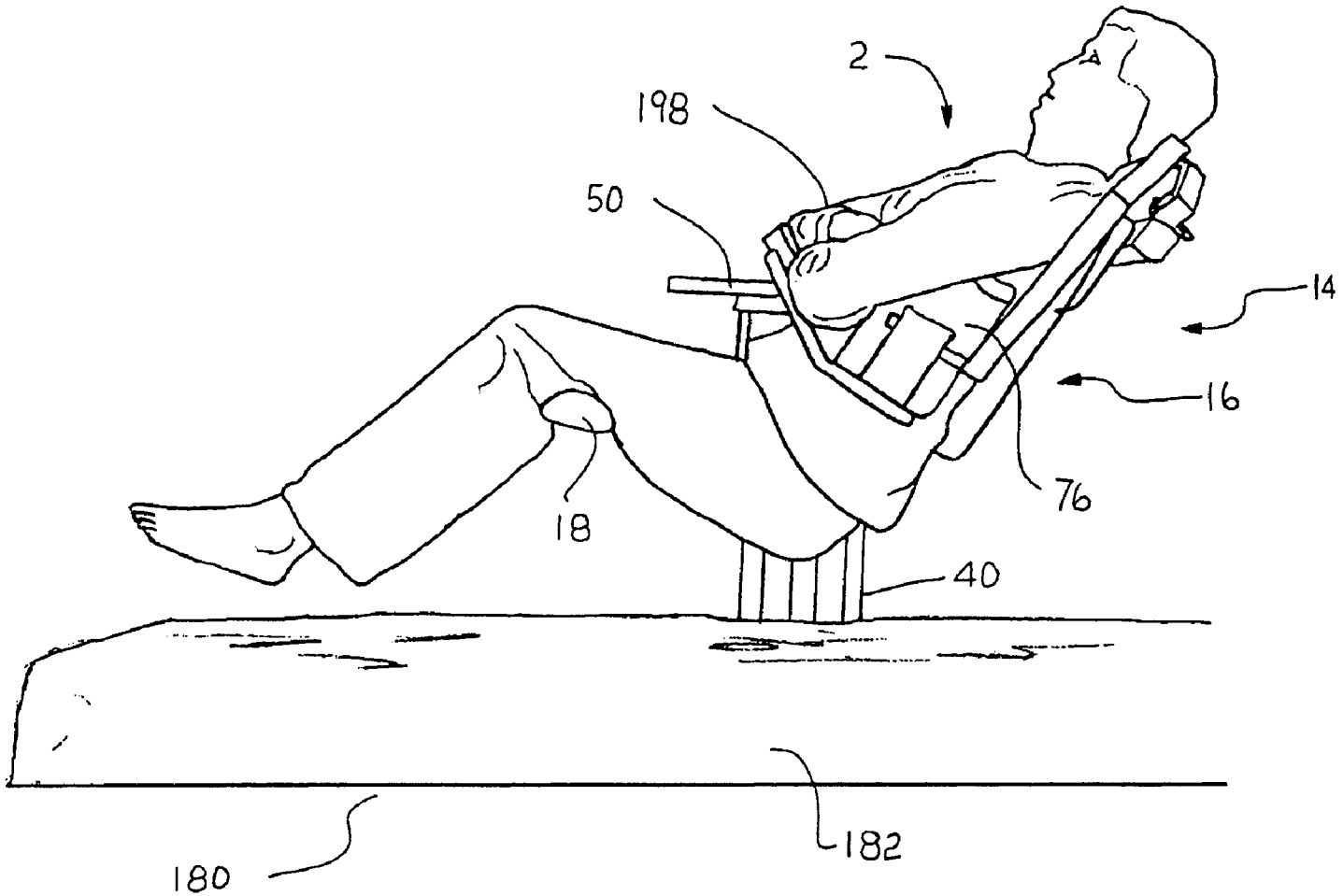

The first and second torso grip pads 74 and 76 in contact with the torso 110 are illustrated in FIG. 9, which illustrates the patient 2 lifted above the hospital bed 180 with the upper arms of the patient 2 placed on the forearm supports 98 and 100 (FIG. 2). The lifting is accomplished in response to actuation by an operator of the switch 50 to the "raise" position to operate the lift 40. Once the patient 2 is raised above the hospital bed 180, the switch 50 returns to the off position, and the lift and transfer device 1 is moved away from the first location. During this movement, the patient 2 may be left in the first position for enhanced comfort. The patient 2 needs to be moved from the first position to a second position. This movement may be done at the second location or be done intermediate between the first and second location. An operator operates the clutch control lever 66 to the second position, and the locking mechanism 144 permits rotation of the support shaft 62. (FIG. 1) The operator then rotates the patient handling section 14 as by pressing downwardly on the main support arm 60 on a forward portion, i.e., between the support shaft 62 and the leg support section 18.

Figure 10:
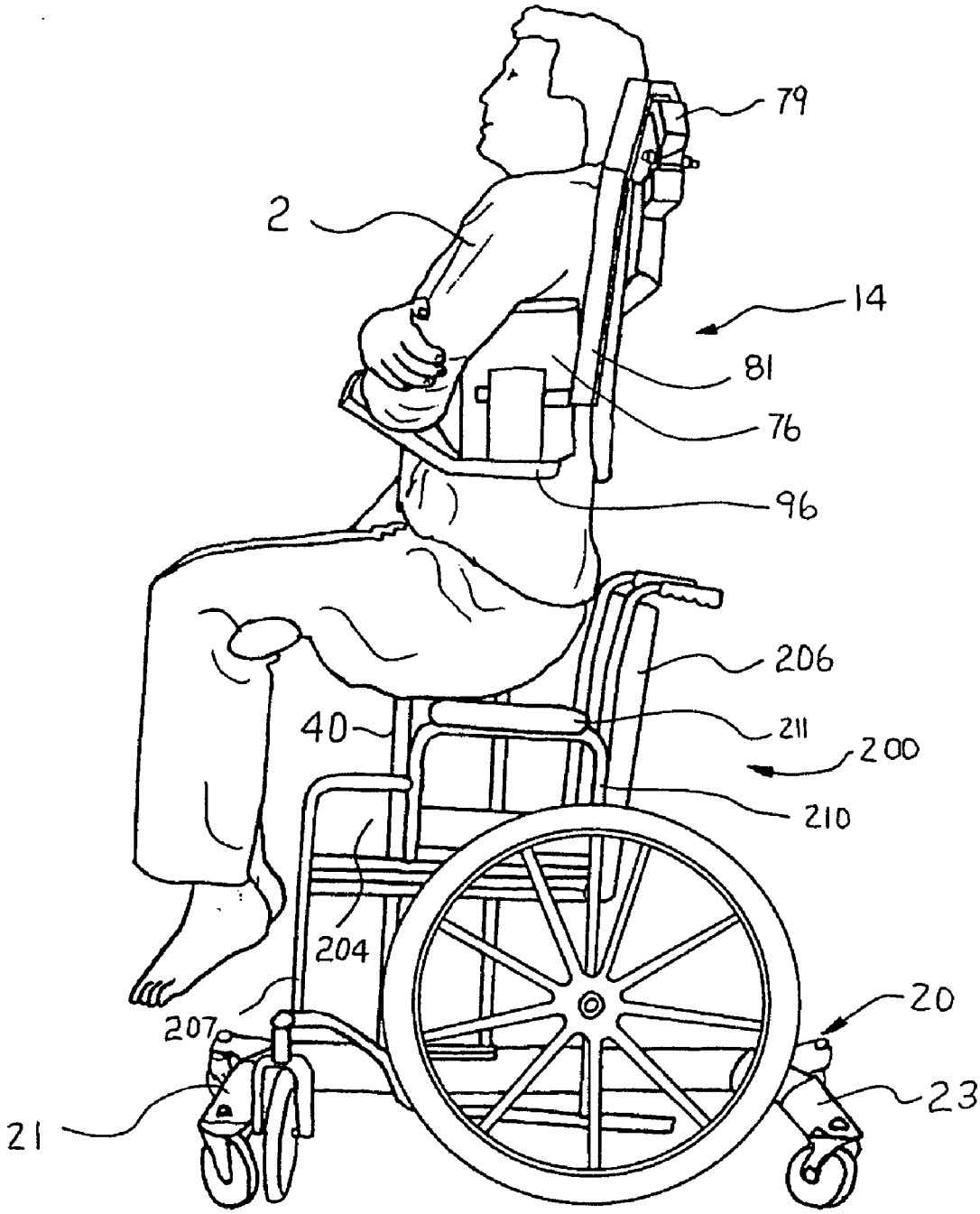
Figure 11:
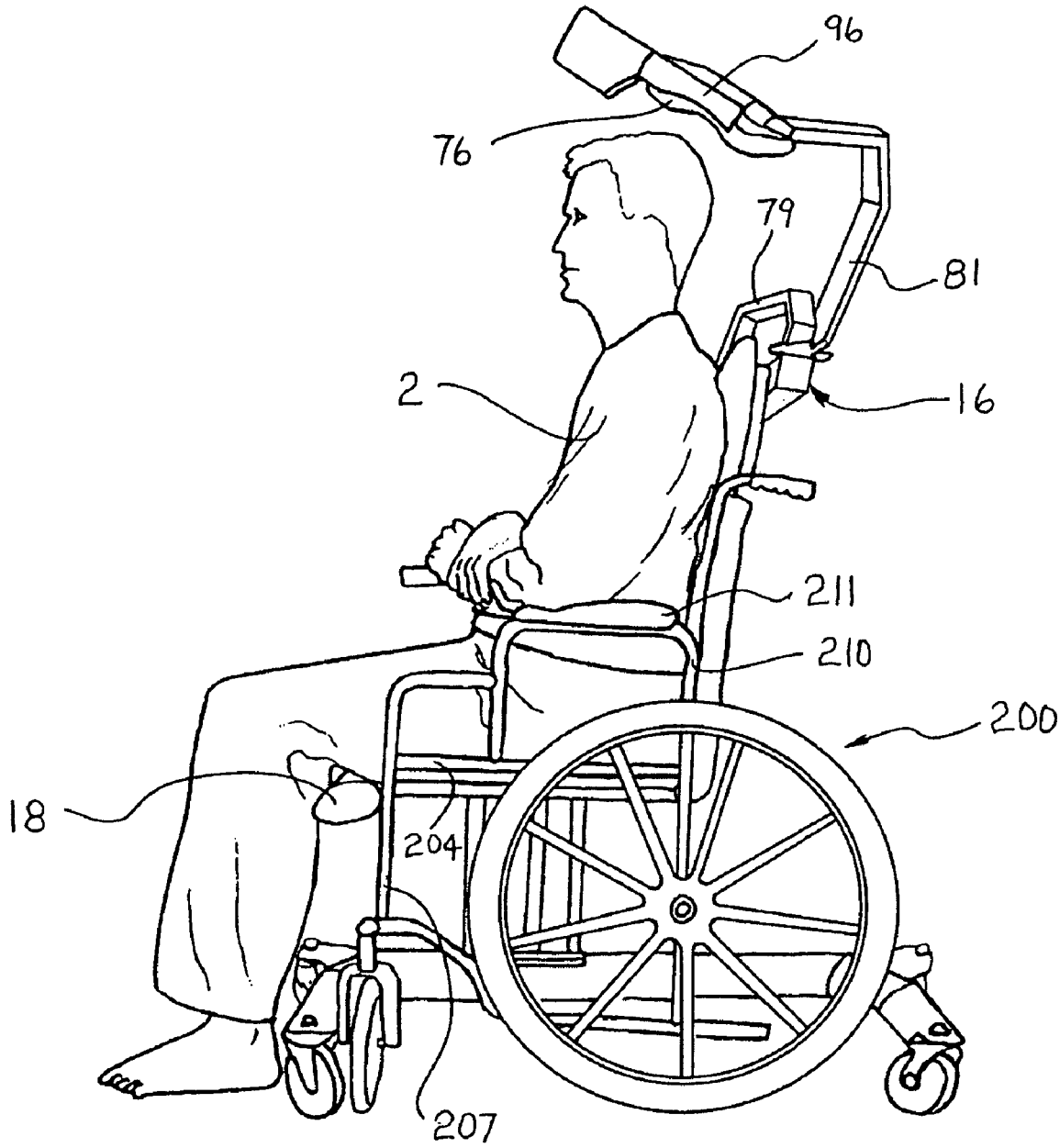

The patient handling section 14 including the patient 2 is rotated about the support shaft 62 to the second position as illustrated in FIG. 10. As the patient 2 progresses from a substantially horizontal disposition to a substantially vertical disposition, the patient's weight is transferred from primary application to the backrest 72 to the first and second torso grip pads 74 and 76. Gripping force is applied to the torso as explained above with respect to FIG. 6. In accordance with the present invention, the force applied to the torso 110 of the patient 2 is increased as weight applied to the backrest 72 is decreased. The device 1, if not already in the second location, is moved to the second location. In the present example, the second location is a position in which the legs 21 and 23 of the platform 20 are in front of and behind a wheelchair 200, respectively, with the patient 2 positioned above a seat 204 of the wheelchair 200. The operator operates the switch 50 to operate the lift 40 in the "lower" mode. The patient 2 is lowered into the seat 204, as illustrated in FIG. 11. Since the leg support section 18 and back support section 16 leave thighs and buttocks of the patient 2 free, once the patient's weight is on the seat 204, no other operations need be performed to effect seating of the patient 2 in the wheelchair 200. The backrest 72 is between the patient 2 and a back 206 of the wheelchair 200. Vertical ingress and egress from the wheelchair 200 are simple.

After the patient 2 is seated, the pivot arm 81 is swung away from the patient 2. The pivot arm 79 may then be swung without hitting the pivot arm 81. A minor amount of movement of an arm of the patient 2 is required to allow disengagement of the first torso grip pad 74. The lift and transfer device 1 may be moved transversely from the wheelchair 200. As noted above with respect to FIG. 1, since the open side of the U-shaped platform 20 is on an opposite side of the device 1 from the lift 40, lateral movement of the device 1 into and out of the location of the wheelchair 200 is enabled. Consequently, the back support section 16 and the leg support 18 are moved out of engagement with the patient 2 when the device 1 is moved laterally away from the patient 2. Lateral egress from the device 1 and ingress to the device 1 are each facilitated with minimal manipulation of the patient 2.

Reference to the wheelchair 200 may be used to define spatial relationships of components in the lift and transfer device 1. A wide range of wheelchairs will have similar dimensions. Therefore, one set of dimensions within the patient handling section 14 and platform 20 may be selected to interact with many different wheelchairs. As seen in FIGS. 10 and 11, the wheelchair 200 has vertically extending front rails 207 forward of the seat 204. Horizontal rails 210 on either side of the seat 204 carry elbow rests 211. In terms of horizontal relationships, the leg rest 18 is forward of the front rail 207 when the backrest 72 is adjacent to the wheelchair back 206. In the vertical dimension, the first and second torso grip pads 74 and 76 and the first and second arm support units 94 and 96 are supported in a position higher than the wheelchair elbow rests 211 when a patient 2 is positioned on the wheelchair seat 204. The patient 2 contemplated here is a normal patient. One set of dimensions of components will work for a wide range of patients.

FIG. 12 is an axonometric illustration of an embodiment of the lift and transfer device 1 which does not include a wheeled platform 20. In the embodiment of FIG. 12, the lift 40 is mounted at one side of a bed frame 240. The lift 40 operates as a floor hoist. An outrigger support leg 250 supports the lift 40 extending in an opposite direction from the bed frame 240. In an alternative embodiment, the lift 40 is mounted as a floor hoist but is not connected to the bed frame 240. The floor hoist is preferably fixed in close proximity to the bed frame 240.

The main support arm 60 is supported on a pivoted arm 260 which includes a pivot mount 261 about which the main support arm 60 pivots. The pivot mount 261 comprises a motor 262 that drives the main support arm 60 for rotation. The motor 262 may be electric but could take other forms, e.g. a hydraulic motor. The motor 262 can provide rotational power to assist in movement of a bariatric patient. The pivoted arm 260 also includes a main support arm stabilizing means 264 to maintain the main support arm 60 in a selected angular position. The main support arm stabilizing means 264 could comprise a friction drag, detent lock or other well-known means. The pivoted arm 260 is in turn pivoted around a rotatable arm 266, which in turn is supported on a vertical arm 270 fixed to the lift 40. In this embodiment, the selection of a second location is limited to an area adjacent to the bed frame 240 in an area in which the force moment applied from the center of gravity of the patient handling section 14 will result in force supported by the outrigger support leg 250 and not result in instability. The embodiment can be conveniently configured so that the position of center of rotation of the patient handling section 14 approximates that of the center of gravity of the patient handling section 14. Generally the center of rotation will be slightly above the center of gravity, providing for ease in rotating the patient 2.

Figure 13A:
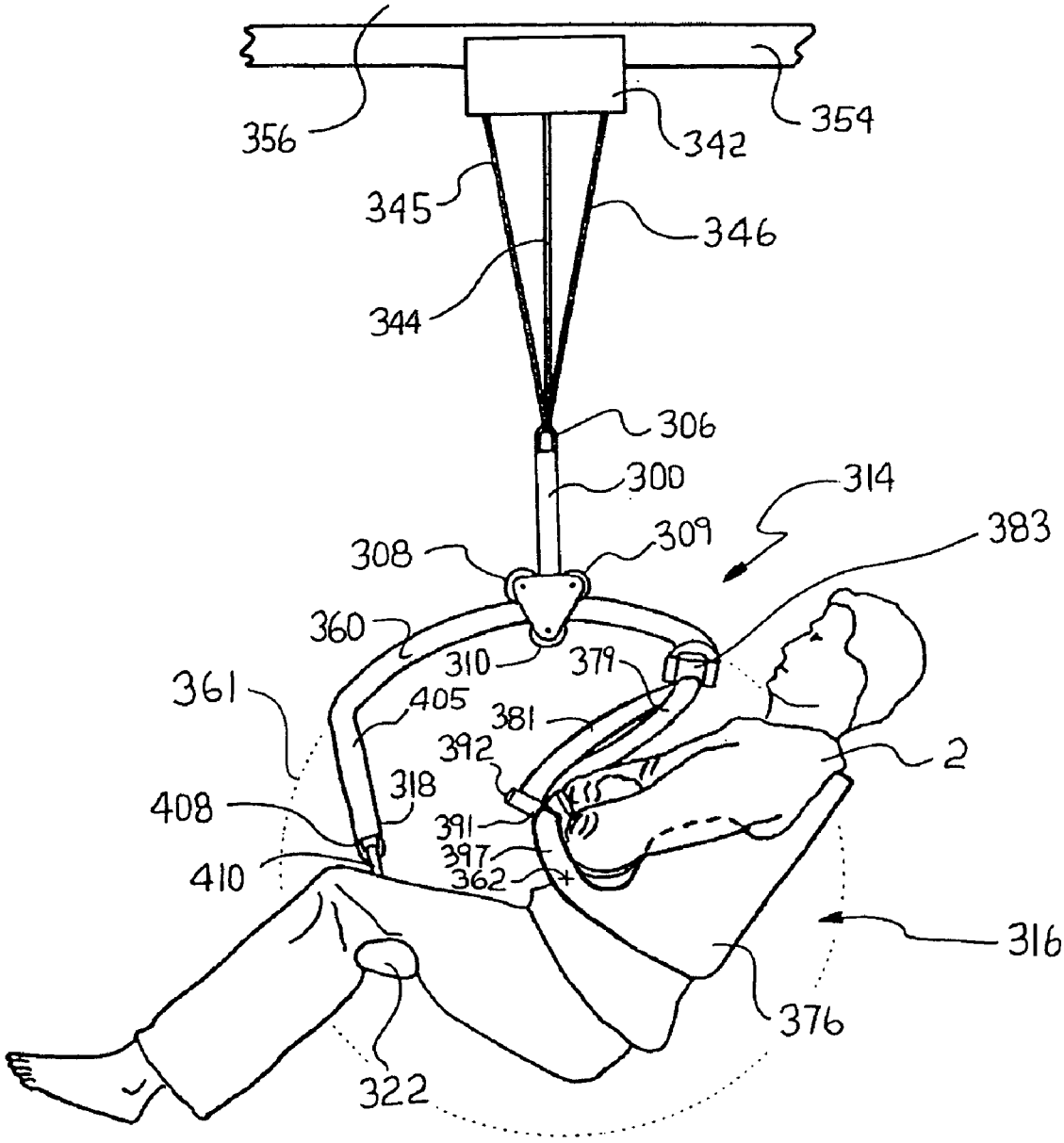
FIG. 13 consists of FIGS. 13*a* and 13*b* which are, respectively, an elevation of an embodiment supported to an overhead lift and a plan view, looking upward, of overhead support means.
Figure 13B:
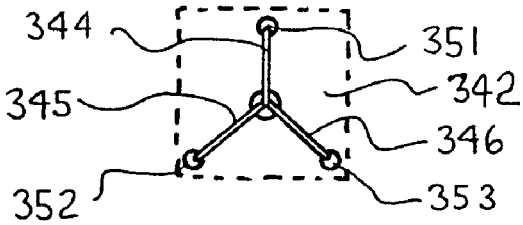
Figure 14:
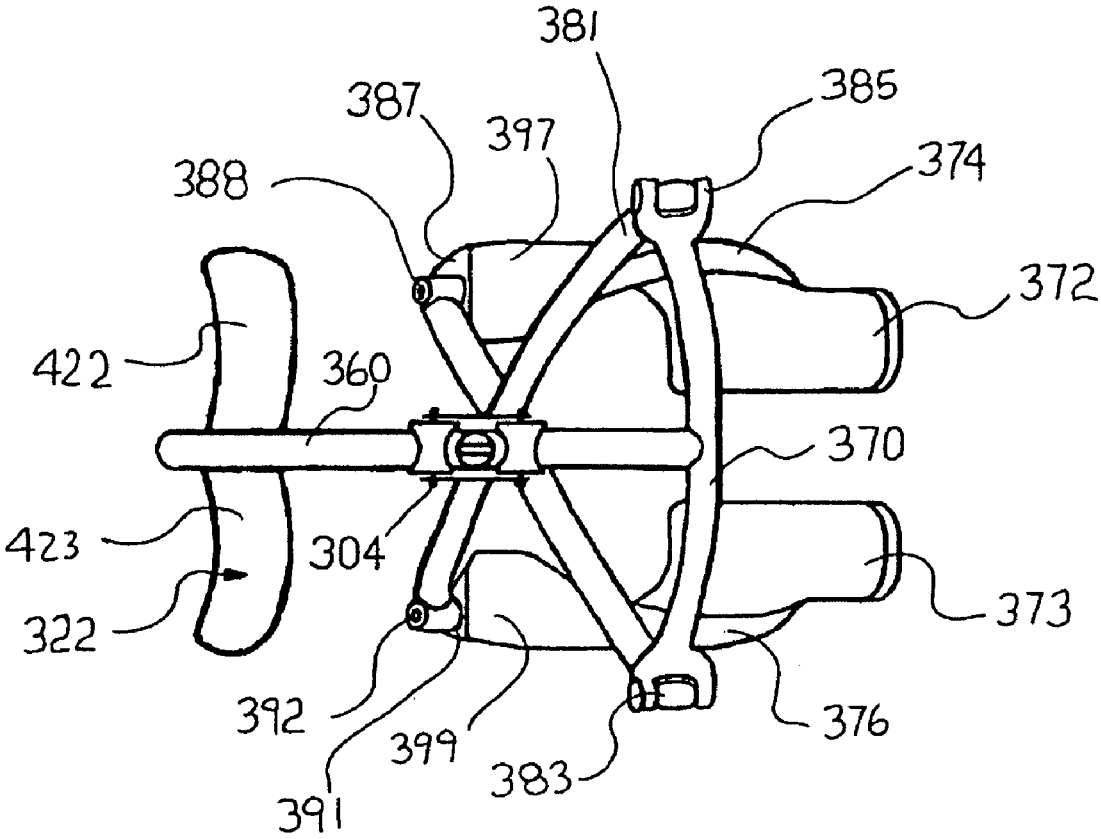
FIG. 14 is a plan view of the embodiment of FIG. 13.

In the embodiment of FIGS. 13*a* and 14, which are respectively an elevation and a plan view, provision is made to employ the capabilities of a well-known overhead lift. FIG. 13*b* is a plan view, looking upward, of support means coupling a patient handling section to the overhead lift. The overhead lift may support the patient handling section to an overhead lift frame or to a ceiling. Further forms of the main support arm 60 and back support section 16 are provided.

A patient handling section 314 includes a main support arm 360 supported to a lower end of a liftable arm 300 by a roller assembly 304 having a lower end pivotally coupled to the liftable arm 300. An upper end of the liftable arm 300 comprises a coupler 306 which is supported by a standard overhead lift 342. The coupler 306 may be supported by the overhead lift 342 by a cable 344. In order to prevent swinging of the patient handling section 314 from the overhead lift 342, second and third cables 345 and 346 are also provided. As seen in FIG. 13*b*, the cables 344, 345, and 346 meet at a first end at a central junction 350 which is coupled to the coupler 306. Opposite ends of the cables 344, 345, and 346 are received in reel ports 351, 352, and 353 respectively. The locations of the reel ports 351, 352, and 353 form a triangle. Three-point support is provided so that swaying will not occur as it would with suspension from a single cable. Powered reels in the ceiling lift 342 will reel in or play out the cables 344, 345, and 346 and raise or lower the patient handling section 314. The cables 344, 345 and 346 comprise antisway means. The overhead lift 342 may be supported for movement from a first location to a second location along a rail 354 mounted to a ceiling 356. Alternatively, the rail 342 may comprise part of a lifting frame. The cables 344, 345, and 346 could comprise separate cable lengths. Alternatively, they may be components of one continuous cable running over a series of pulleys.

The roller assembly 304 comprises first, second and third rollers 308, 309 and 310 through which the main support arm 360 is moveable. For this purpose, the main support arm 360 may comprise a tube having a circular cross section, and the rollers 308, 309, and 310 may comprise pulleys each having a curved outer diameter essentially complementing the curvature of the main support arm 360. The third roller 310 is below the main support arm 360, and the first and second rollers 308 and 309 are mounted above. The main support arm is located at the center of a patient handling section 314 rather than at a side thereof. Rather than being rotatable around an axis as is the main support arm 60 (FIG. 1), the main support arm 360 is curved. The curvature of the main support arm is selected to define a circle 361 having a center 362. The center 362 may be described as the center of radius of the main support arm 360, at a position approximating the center of gravity of the patient handling section 314 with a patient therein. Thus even though the main support arm 360 is not pivoted and it translates through the roller assembly 304, it is nonetheless mounted for rotational movement. This disposition of the main support arm 360 may be described as being effectively pivoted about the center 362. Effectively rotating about a position approximating that of the center of gravity of the patient handling section 314 maximizes stability in position of the patient 2 and minimizes physical exertion required of an operator.

The patient handling section 314 includes a back support section 316 supported on a first, rear end of the main support arm 360. A leg support section 318 is supported on a second, front end of the main support arm 360. The leg support section includes a leg rest 322. The back support section 316, as seen with respect to FIG. 14 as well as FIG. 13*a*, comprises a back support arm 370 supported at its center to the first, rear end of the main support arm 360. First and second torso grip pads 374 and 376 grip proximal and distal sides of the patient 2. "Proximal" and "distal" here are arbitrary terms only indicating relative positioning corresponding to the relative positions in the embodiments described in FIGS. 13-14. The first and second torso grip pads 374 and 376 are supported to first ends of pivot arms 379 and 381, respectively. The first and second torso grip pads 374 and 376 are curved with an anatomical contour approximating a patient torso shape for greater surface area of contact than a flat pad. The first and second torso grip pads 374 and 376 are padded to permit deformation to conform to a patient's contour, providing for uniform load distribution and for greater comfort. Second ends of the pivot arms 379 and 381 are mounted to pivot supports 383 and 385 respectively.

The first torso grip pad 374 has extending from an outside surface (away from the patient 2) thereof a first support block 387. The first support block 387 is pivotally mounted on a first longitudinal arm 388 extending from the first end of the pivot arm 379. Similarly, the second torso grip pad 376 has extending from an outside surface thereof a second support block 391. The second support block 391 is pivotally mounted on a second longitudinal arm 392 extending from the first end of the pivot arm 381. The first and second support blocks 387 and 391 are preferably unitary with the first and second torso grip pads 374 and 376 respectively. The first and second torso grip pads 374 and 376 are consequently self-adjusting to engage the sides of the patient 2. The pivot arms 379 and 381 are disposed in front of the patient 2.

In this embodiment, the back support section 316 does not have a separate backrest. A first back support section 372 curves from the first torso grip pad 374 to define a back support for the proximal side of the patient 2. A second back support section 373 curves around from the second torso grip pad 376 to comprise a back support for the distal side of the patient 2. Reliable back support will be provided in the first and second positions (as defined above) even when the first and second back support sections 372 and 373 do not meet. First and second elbow supports 397 and 399 may be formed integrally with the first and second torso grip pads 374 and 376, respectively, between them and the pivot support arms 379 and 381, respectively.

The main support arm 360 may have a straight section 405 extending into the circle 361 to support the leg rest 322. The leg rest 322 is preferably at a position on or near the diameter of the circle 361. This construction is analogous to the location of the leg rest 22 in FIG. 1 on a straight beam rotating approximately about the center of gravity of the patient handling section 14. The leg rest 322 has a central support 410 supported to a hook 408 at a lower end of the section 405. First and second proximal and distal leg supports 422 and 423 each extend away from the central support 410. The leg supports 422 and 423 each have a cross section which is a crescent or other shape providing for spreading of load and for minimal interference with wheelchairs.

Figure 15:
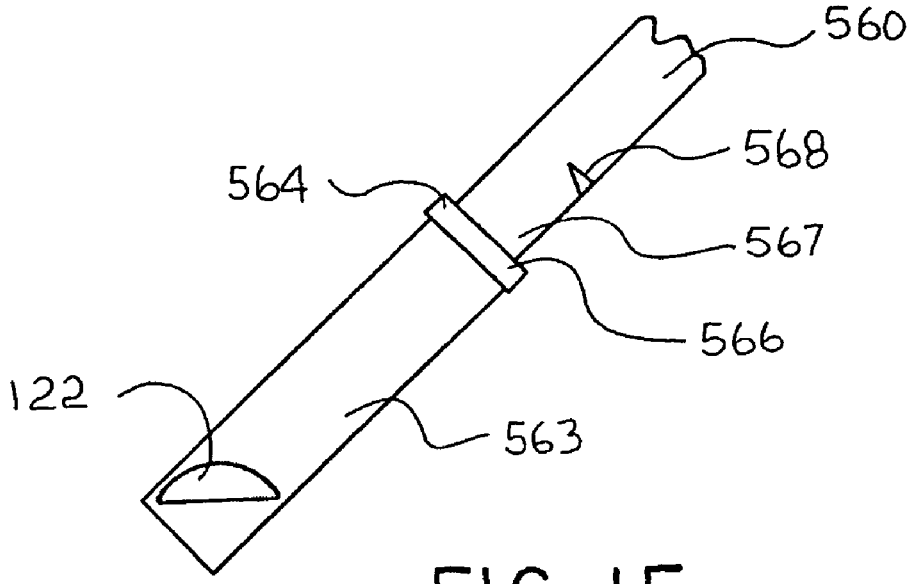
FIGS. 15 and 16 are partial elevations of further embodiments of a main support arm.
Figure 16:
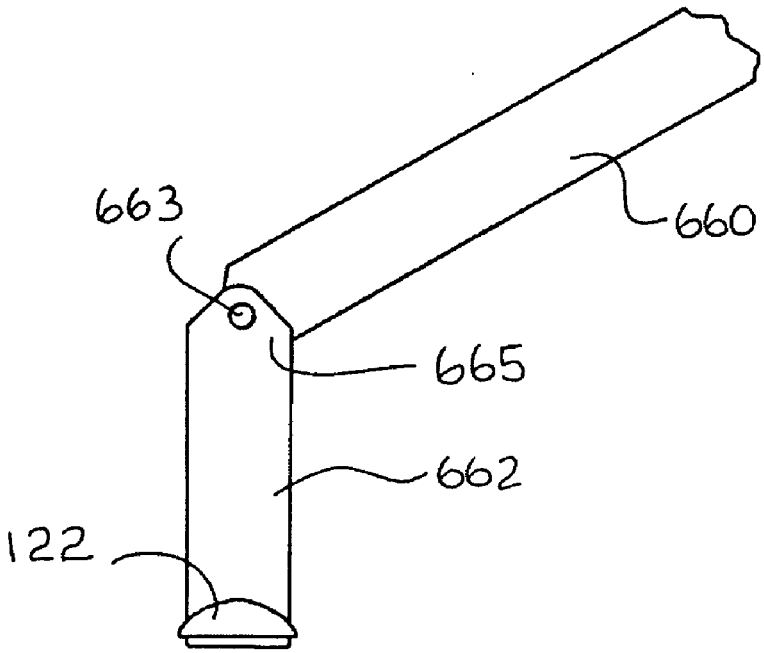

FIGS. 15 and 16 are each a partial elevation of a further form of the main support arm 60 providing different ways in which position of the leg rest 122 may be adjusted with respect to the patient handling section 14. In the embodiment of FIG. 15, a main support arm 560 is provided with a concentric telescoping arm 563 at a forward end thereof having the leg rest 122 formed thereon. As further described below, the telescoping arm 563 may be moved to cover more or less of the main support arm 560. In this manner, the main support arm 560 is effectively shortened or lengthened. The leg rest 122 is consequently closer to or farther from the back support section 16 (FIG. 1). A collar 564 may be provided at a first, rear end of the telescoping arm 563. The collar 564 is partially broken away to illustrate a detent 566 projecting radially inwardly at the rear end of the telescoping arm 563. A forward end of the main support arm 560 has at least two longitudinally spaced notches 567 and 568 formed therein so that the position of the telescoping arm 563 may be moved to engage the detent 566 in one of the notches 567 or 568. The inner diameter of the telescoping arm 563, outer diameter of the main support arm 560, notches 567 and 568 and the detent 566 are proportioned for convenient adjustment. An operator may lift the leg rest 122 (or other portion of the telescoping arm 563) so that the telescoping arm pivots to disengage the detent 566 from either notch 567 or 568. The telescoping arm 563 is slid to put the detent 566 in registration with one of notch 567 or 568. When the telescoping arm 563 is released, it and the main support arm will resume a relationship in which their axes are parallel and the detent 566 is received in either notch 567 or 568.

In the embodiment of FIG. 16, main support arm 660 has a forward end section 662 supported thereto by a pivot connection 663. The forward end section 662 pivots freely. However, the extent of rotation of the forward end section 662 may be limited by stop means 665.

Figure 17:
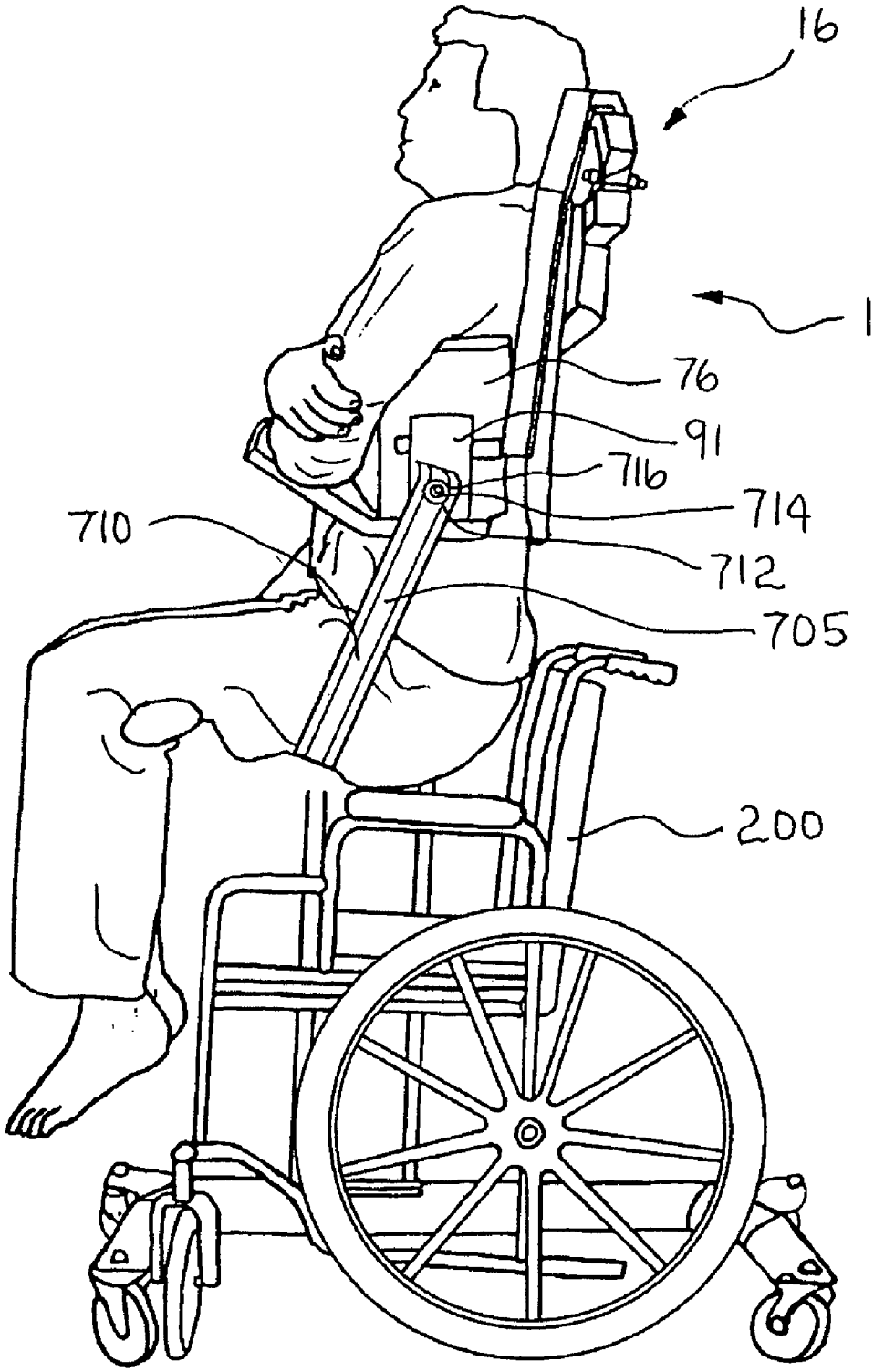
FIG. 17 is an elevation of a further embodiment suited, for example, for bariatric applications.

In the embodiment of FIG. 17, the same reference numerals are used to denote elements corresponding to those in FIGS. 1-11. One of the uses for the embodiment of FIG. 17 is in applications for bariatric patients. In bariatric applications, the patient 2 may have an unfavorable ratio of upper body weight to upper arm strength. Therefore, it is useful to provide a means to positively prevent slipping of the patient in the back support portion 16. The back support section 16 further comprises vertical weight support means 705. The vertical weight support means comprises means for providing a vertical reaction to forces vertically applied by the body of the patient 2 and for translating those forces to other portions of the lift and transfer device 1.

In the embodiment of FIG. 17, the vertical weight support means 705 comprises a strap 710 supported at first and second ends to the first and second support blocks 87 and 91. Each end of the strap 710 includes a grommet 712 defining an aperture 714. Each support block 87 and 91 has a hook 716 extending therefrom to receive a grommet 712. The strap 710, grommet 712 and hook 716 may be made of readily available materials, each capable of withstanding forces of hundreds of pounds. In use, the strap 710 may be placed under a patient 2 while the patient 2 is the first position, for example, at a first location as in FIG. 8. The patient 2 does not have to be lifted to get the strap underneath him or her. As the patient is rotated to the second position, as in FIG. 17, vertically applied weight is received by the strap 710 so that the patient 2 is positively supported. The strap 710 provides a vertical reaction to the weight of the patient 2. This force applied to the strap 710 is translated by the hooks 716 to the first and second support blocks 87 and 91. With the weight being applied to the first and second support blocks 87 and 91, further compressive force is applied to the patient 2 by the first and second torso grip pads 74 and 76. This results in further security in supporting the patient 2. When the patient is lowered into the wheelchair 200, removing the strap 710 is a simpler process than removing prior art slings. Alternatively, the strap 710 may be unhooked from the hooks 716 and left in place. The strap 710 has a small bulk and will not interfere with comfort or blood circulation of the patient 2. The strap 710 will then not have to be replaced under a patient 2 for the transfer back to a bed.

The present subject matter being thus described, it will be apparent that the same may be modified or varied in many ways. Such modifications and variations are not to be regarded as a departure from the spirit and scope of the present subject matter, and all such modifications are intended to be included within the scope of the following claims.

What is claimed is:

1. A patient lift and transfer device comprising:

a main support arm rotatable about a horizontal axis between a first position and a second position, and about a balance point in approximate spatial registration with an expected center of gravity of a patient and rotated elements of said device, said horizontal axis extending through a patient position;

a back support arm supported to said main support arm;

a backrest member supported to said back support arm and providing predominant support when said main support arm is in the first position;

a torso support supported to said main support arm engaging and providing predominant support to a patient's torso when said main support arm is in the second position; and a leg support mounted to said main support arm in a selected spatial relationship to said back support arm.

2. A device according to claim 1, wherein said main support arm is mounted for pivotal rotation with respect to a support.

3. A device according to claim 2, wherein said main support arm is mounted on a pivot mount.

4. A device according to claim 3, wherein said pivot mount comprises a friction drag.

5. A device according to claim 3, wherein said pivot mount comprises a drive motor.

6. A device according to claim 2, wherein said main support arm is supported on an arcuate section and tilts about a center of radius as said arcuate section translates along a roller support supporting said arcuate section.

7. A device according to claim 2, wherein said back support arm and said leg support are cantilevered from said main support arm.

8. A device according to claim 7, wherein said leg support has a segment cross section.

9. A device according to claim 7, further comprising a vertical lift, wherein said main support arm is pivotally mounted to said vertical lift.

10. A device according to claim 9, further comprising a carriage, wherein said vertical lift is mounted to a side of said carriage.

11. A device according to claim 10, wherein said carriage comprises a wheeled platform.

12. A device according to claim 10, wherein said wheeled platform comprises tubing in a U-shape.

13. A device according to claim 12, wherein an open side of said U-shape is disposed at a side of said carriage opposite to the side of said carriage mounted to said vertical lift.

14. A patient lift and transfer device comprising:

a main support arm rotatable between a first position and a second position;

a back support arm supported to said main support arm;

a backrest member supported to said back support arm and providing predominant support when said main support arm is in the first position;

a torso support supported to said main support arm engaging and providing predominant support to a patient's torso when said main support arm is in the second position; and a leg support mounted to said main support arm in a selected spatial relationship to said back support arm, wherein said torso support comprises first and second pivot arms supported on said back support arm, each of said pivot arms positioned to provide a horizontal reaction in response to weight of a patient positioned in said device, wherein said horizontal reaction directly counters a vertical body weight load of said patient, and wherein each of said pivot arms apply a force F to a side of a patient of:

$$F=(\text{weight})\tan\theta$$

where weight is an amount of the patient's weight supported by said pivot arm and θ is an angle with respect to vertical at which said pivot arm is disposed.

15. A device according to claim 14, wherein said leg support and said back support arm are positioned on said main support arm to allow lowering of a patient into a wheel chair.

16. A device according to claim 15, wherein the position of said leg support with respect to said back support arm is adjustable.

17. A device according to claim 16, wherein said main support arm comprises a telescoping end having said leg support mounted thereto.

18. A device according to claim 16, wherein said main support arm has a pivoted end having said leg support mounted thereto, said pivoted end being fixable at a selected angle to said main support arm.

19. A device according to claim 14, wherein at least one of said pivot arms is movable about a pivot point to permit free movement of a patient for ingress and egress from said device.

20. A device according to claim 19, wherein a length of said pivot arm is selected to engage sides of the patient and avoid engaging armpits of the patient.

21. A device according to claim 14, further comprising torso grip pads supported on each pivot arm to engage a patient and having a coefficient of friction at a point of engagement with the patient.

22. A device according to claim 21, wherein said force is applied by each of said torso grip pads.

23. A device according to claim 21, wherein said torso grip pads are anatomically shaped.

24. A device according to claim 21, further comprising arm support units supported on each of said pivot arms.

25. A device according to claim 24, wherein each of said arm support units is positioned to support an elbow region of the patient to transmit force to a humerus in an arm of the patient.

26. A device according to claim 14, wherein said backrest member comprises first and second sections respectively mounted to said first and second pivot arms.

27. A device according to claim 14, wherein first ends of each of said first and second pivot arms are mounted to said back support arm behind said back rest member and above the patient's torso, and further comprising first and second torso grip pads mounted to second ends of said first and second pivot arms, said first and second pivot arms being swingable in overlapping arcs.

28. A device according to claim 14, wherein said back support arm is positioned to be forward of the patient and comprises torso grip pads extending rearwardly from each pivot arm.

29. A device according to claim 14, further comprising detachable support means supportable on said first and second pivot arms to receive weight of a patient.

30. A device according to claim 14, wherein said back support arm and said leg support are centered with respect to said main support arm.

31. A device according to claim 30, further comprising a mount to mount said main support arm to an overhead lift.

32. A device according to claim 31, further comprising a roller to support said main support arm and wherein said main support arm comprises an arcuate section supported for translation on said roller.

33. A device according to claim 32, further comprising an arm supporting said roller at a first end and being supported on said mount at a second end.

34. A device according to claim 14, further comprising a mount supporting said main support arm on a floor hoist.

35. A device according to claim 14 comprising a patient support unit consisting of:

said main support arm;

said back support arm;

said backrest member;

said torso support; and said leg support.

36. An overhead patient lift and transfer system comprising:

an overhead lift;

a main support arm rotatable between a first position and a second position;

a mount supporting said main support arm to said overhead lift;

a back support arm supported to the main support arm;

a backrest member supported to said back support arm and providing predominant support when said main support arm is in the first position;

a torso support supported to said back support arm and providing predominant support when said main support arm is in the second position; and a leg support mounted to said main support arm in a selected spatial relationship to said back support arm, wherein said torso support comprises first and second pivot arms supported on said back support arm, each of said pivot arms positioned to provide a horizontal reaction in response to weight of a patient positioned in said device, wherein said horizontal reaction directly counters a vertical body weight load of said patient, and wherein each of said pivot arms apply a force F to a side of a patient of:

$$F=(\text{weight})\tan\theta$$

where weight is an amount of the patient's weight supported by said pivot arm and θ is an angle with respect to vertical at which said pivot arm is disposed.

37. A system according to claim 36 further comprising anti-sway means coupled between said mount and said overhead lift.

38. A floor mounted patient lift and transfer system comprising a floor hoist;

a main support arm rotatable about a horizontal axis between a first position and a second position, and about a balance point in approximate spatial registration with an expected center of gravity of a patient and rotated elements of said device, said horizontal axis extending through a patient position;

a mount supporting said main support arm to said floor hoist;

a back support arm supported to the main support arm;

a backrest member supported to said back support arm and providing predominant support when said main support arm is in the first position;

a torso support supported to said back support arm and providing predominant support when said main support arm is in the second position; and a leg support mounted to said main support arm in a selected spatial relationship to said back support arm, said leg support and said back support being located on opposite sides of said axis.

39. A system according to claim 38, further comprising a pivot arm supporting said main support arm for movement around a vertical axis between a first location and a second location.

40. A method of moving a patient comprising:

supporting a patient in a lift and transfer device by providing support under the patient's legs and providing support for the patient's torso and back;

selectively supporting the patient under the patient's legs and either in a first position predominantly at the patient's back, or in a second position predominantly at the patient's torso by way of a horizontal reaction in response to weight of a patient positioned in said device, wherein said horizontal reaction directly counters a vertical body weight load of said patient by applying a force F to a side of a patient of:

$$F=(\text{weight})\tan\theta$$

where weight is an amount of the patient's weight supported at the side of the patient, and θ is an angle with respect to vertical at which an arm applying said force is disposed;

engaging the patient in the lift and transfer device while the patient is supported by a support device;

lifting the patient from the support device while supported in one of said positions; and rotating the patient to dispose the patient in another of said positions, while increasing force applied to a patient's sides and shifting predominant weight support from the patient's back to the patient's torso if moving from the first position to the second position or decreasing force applied to a patient's sides and shifting predominant weight support from the patient's torso to the patient's back if moving from the second position to the first position.

41. A method according to claim 40, further comprising moving said patient from a first location at a first support device to a second location at a second support device.

42. A method according to claim 41, further comprising lowering the patient to said second support device.

43. A method according to claim 42, comprising supporting the patient in said first position while moving the patient from the first location to the second location.

* * * * *